US011707113B2

(12) United States Patent
Hopkins et al.

(10) Patent No.: US 11,707,113 B2
(45) Date of Patent: Jul. 25, 2023

(54) EASY-ACCESS ARTICLE OF FOOTWEAR WITH CORD LOCK

(71) Applicant: NIKE, Inc., Beaverton, OR (US)

(72) Inventors: Timothy P. Hopkins, Lake Oswego, OR (US); Elizabeth Langvin, Sherwood, OR (US); Haley L. Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 327 days.

(21) Appl. No.: 17/068,081

(22) Filed: Oct. 12, 2020

(65) Prior Publication Data

US 2021/0112924 A1 Apr. 22, 2021

Related U.S. Application Data

(60) Provisional application No. 62/923,013, filed on Oct. 18, 2019.

(51) Int. Cl.
*A43B 11/00* (2006.01)
*A43C 1/06* (2006.01)

(52) U.S. Cl.
CPC ..... *A43C 1/06* (2013.01); *A43B 11/00* (2013.01)

(58) Field of Classification Search
CPC ... A43B 11/00; A43B 23/0295; A43B 13/141; A43C 11/004; A43C 11/1493; A43C 11/20; Y10T 24/3724; F16G 11/101
See application file for complete search history.

(56) References Cited

U.S. PATENT DOCUMENTS 4,497 A 5/1846 Vetter
75,048 A 3/1868 Perley
(Continued)

FOREIGN PATENT DOCUMENTS

CN 87209219 U 5/1988
CN 87103983 A 12/1988
(Continued)

OTHER PUBLICATIONS

Aidin H., Under Armour's Innovative Fall/Winter 2016 Collection Now Available at All Brand Houses, Aug. 27, 2016, https://www.runsociety.com/news/under-armours-fallwinter-2016-collection-now-available-at-all-brands-houses/ (accessed Nov. 4, 2017).
(Continued)

*Primary Examiner* — Jillian K Pierorazio
(74) *Attorney, Agent, or Firm* — Quinn IP Law

(57) ABSTRACT

An article of footwear includes a sole structure, a footwear upper, and a closure system. The sole structure may have a front sole portion and a rear sole portion pivotable relative to the front sole portion between a use position and an access position. The footwear upper may be fixed to the front sole portion and to the rear sole portion. The closure system may comprise an adjustment cord and a cord lock. The adjustment cord may be operatively secured to the footwear upper at an anchor location. The cord lock may be secured to the footwear upper and may be configured so that the adjustment cord slides through the cord lock when under tension to tighten the footwear upper in the use position, and the adjustment cord is repositionable relative to the cord lock to lock to the cord lock and retain tension in the adjustment cord.

20 Claims, 14 Drawing Sheets

(56) References Cited

U.S. PATENT DOCUMENTS 171,301 A 12/1875 McKee
417,460 A 12/1889 Wurtele
474,574 A 5/1892 Bruzon
503,588 A 8/1893 Elterich et al.
537,627 A 4/1895 Bixby et al.
558,937 A 4/1896 Edmonds
808,948 A 1/1906 Roberts
827,330 A 7/1906 Tillson
863,549 A 8/1907 Metz
955,337 A 4/1910 Lawlor
1,081,678 A 12/1913 Langerak
1,494,236 A 5/1924 Greathouse
1,585,049 A 5/1926 Skoglund
1,603,144 A 10/1926 Nichols
1,686,175 A 10/1928 Read
1,812,622 A 6/1931 Costello
1,863,592 A * 6/1932 Dawes ..... A43C 11/004
36/50.1
2,069,752 A 2/1937 Dorr
2,252,315 A 8/1941 Doree
2,302,596 A 11/1942 Bigio
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,283,423 A 11/1966 Schovee
3,349,505 A 10/1967 Lopez
3,400,474 A 9/1968 Tendler
3,436,842 A 4/1969 Sachs
3,681,860 A 8/1972 Bidegain
4,095,356 A 6/1978 Robran et al.
4,136,468 A 1/1979 Munschy
4,288,891 A 9/1981 Boden
4,309,832 A 1/1982 Hunt
4,489,509 A 12/1984 Libit
4,507,879 A 4/1985 Dassler
4,559,724 A 12/1985 Norton
4,562,651 A 1/1986 Frederick et al.
4,573,457 A 3/1986 Parks
4,594,798 A 6/1986 Autry et al.
4,599,811 A 7/1986 Rousseau
4,615,126 A 10/1986 Mathews
4,649,656 A 3/1987 Cox et al.
4,665,634 A 5/1987 Diaz
4,776,111 A 10/1988 Crowley
4,944,099 A 7/1990 Davis
4,959,914 A 10/1990 Hilgarth
4,972,613 A 11/1990 Loveder
5,054,216 A 10/1991 Lin
5,060,401 A 10/1991 Whatley
5,090,140 A 2/1992 Sessa
5,127,170 A 7/1992 Messina
5,152,082 A 10/1992 Culpepper
5,181,331 A 1/1993 Berger
D333,377 S 2/1993 Hatfield
5,184,410 A 2/1993 Hamilton
5,222,313 A 6/1993 Dowdy et al.
5,279,051 A 1/1994 Whatley
5,282,327 A 2/1994 Ogle
5,341,583 A 8/1994 Hallenbeck
5,345,698 A 9/1994 Billet et al.
5,371,957 A 12/1994 Gaudio
5,467,537 A * 11/1995 Aveni ..... A43C 11/00
24/712.1
5,481,814 A 1/1996 Spencer
5,557,866 A 9/1996 Prengler
5,570,523 A 11/1996 Lin
5,682,687 A 11/1997 Arai
5,813,144 A 9/1998 Prengler
5,842,292 A 12/1998 Siesel
5,884,420 A 3/1999 Donnadieu
5,956,823 A * 9/1999 Borel ..... A43C 7/00
24/712.9
5,983,530 A 11/1999 Chou
5,997,027 A 12/1999 Jungkind
6,000,148 A 12/1999 Cretinon
6,185,798 B1 * 2/2001 Ton ..... F16G 11/101
24/712.1
6,189,239 B1 * 2/2001 Gasparovic ..... A43B 13/141
36/102
6,290,559 B1 9/2001 Scott
6,298,582 B1 10/2001 Friton et al.
6,334,240 B1 1/2002 Li
6,378,230 B1 4/2002 Rotem et al.
6,381,816 B1 5/2002 Lai et al.
6,438,872 B1 8/2002 Chil et al.
6,557,271 B1 5/2003 Weaver, III
6,578,288 B2 6/2003 Bernstein
6,594,921 B2 7/2003 Laio et al.
6,643,954 B2 11/2003 Voswinkel
6,662,415 B1 * 12/2003 Lin ..... A43C 7/00
24/712.9
6,684,533 B1 2/2004 Su
6,718,658 B2 4/2004 Karasawa
6,772,541 B1 * 8/2004 Ritter ..... A43C 11/14
36/91
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
6,964,119 B2 11/2005 Weaver, III
7,055,268 B2 6/2006 Ha
7,059,069 B2 6/2006 Raluy et al.
7,080,468 B2 7/2006 Miller et al.
7,101,604 B1 9/2006 Minges
7,103,994 B2 9/2006 Johnson
7,127,837 B2 10/2006 Ito
7,178,270 B2 2/2007 Hurd et al.
7,188,438 B1 3/2007 Bowen
7,225,563 B2 6/2007 Chen et al.
7,243,399 B2 * 7/2007 Liao ..... B65D 63/14
24/712.9
7,284,341 B2 10/2007 Moseley
7,287,294 B2 10/2007 Miller et al.
7,380,354 B2 * 6/2008 Yamashita ..... A43C 11/1493
36/89
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,823,299 B1 11/2010 Brigham
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
7,984,571 B2 7/2011 Pellegrini
8,006,410 B2 8/2011 Romboli et al.
8,020,317 B1 9/2011 Sokolowski
D648,512 S 11/2011 Schlageter et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck

(56) References Cited

U.S. PATENT DOCUMENTS 8,245,418 B2 * 8/2012 Paintin ..... A43C 11/12 36/138
8,245,421 B2 8/2012 Baudouin et al.
8,256,146 B2 9/2012 Loverin
8,365,443 B2 2/2013 Huynh
D680,719 S 4/2013 Dardinski
8,468,721 B2 6/2013 Sokolowski
8,468,723 B2 6/2013 Malka-Harari
8,499,474 B2 8/2013 Kaufman
8,539,698 B1 9/2013 Woodruff
8,549,774 B2 10/2013 Meschter et al.
8,627,582 B2 1/2014 Perenich
8,627,583 B2 1/2014 Perenich
8,635,791 B2 1/2014 Baudouin et al.
8,656,613 B2 2/2014 Stockbridge et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,044,063 B2 6/2015 Loverin et al.
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,241,748 B2 * 1/2016 Bernstein ..... A61B 17/823
9,254,018 B2 2/2016 Bliss
9,265,305 B2 2/2016 Hatfield et al.
9,301,570 B2 4/2016 Hwang
9,314,055 B2 4/2016 Moran
9,314,067 B2 4/2016 Bock
D758,836 S 6/2016 Symons
D758,837 S 6/2016 Symons
9,363,980 B2 6/2016 Lander
9,392,843 B2 7/2016 Callahan et al.
9,392,844 B1 7/2016 Burrell
9,398,785 B2 7/2016 Horacek
9,398,786 B2 7/2016 Gavrieli et al.
9,414,640 B2 8/2016 Nichols
9,433,256 B2 9/2016 Callahan et al.
9,445,644 B2 9/2016 Cressman et al.
9,474,330 B2 10/2016 Panian et al.
9,480,299 B2 11/2016 Dinndorf et al.
D776,420 S 1/2017 Petrie
9,675,132 B2 6/2017 Marshall
9,820,527 B2 11/2017 Pratt et al.
9,839,261 B2 12/2017 Hatfield et al.
9,854,875 B2 1/2018 Hatfield et al.
9,877,542 B2 1/2018 Pratt
9,936,767 B2 4/2018 Theuvenet et al.
9,949,533 B2 4/2018 Feinstein
10,159,310 B2 12/2018 Sullivan
10,660,401 B1 5/2020 Pratt et al.
10,779,607 B1 9/2020 Chandel
11,000,091 B1 5/2021 Kyle
2002/0144434 A1 10/2002 Farys et al.
2002/0174568 A1 11/2002 Neiley
2003/0200680 A1 10/2003 Chang
2004/0111921 A1 6/2004 Lenormand
2005/0039348 A1 2/2005 Raluy et al.
2005/0060913 A1 3/2005 Chil et al.
2005/0066548 A1 3/2005 Chil et al.
2006/0080864 A1 * 4/2006 Chen ..... A43C 11/14 36/89
2007/0011917 A1 1/2007 Hayes
2007/0039208 A1 2/2007 Bove et al.
2007/0074425 A1 4/2007 Leong
2007/0107265 A1 * 5/2007 Mueller ..... A43B 13/16 36/102
2007/0186441 A1 8/2007 Chen
2007/0199211 A1 8/2007 Campbell
2007/0199213 A1 8/2007 Campbell et al.
2007/0209234 A1 9/2007 Chou
2008/0000106 A1 1/2008 Dulpepper
2008/0086911 A1 4/2008 Labbe
2008/0115334 A1 5/2008 Chen et al.
2008/0141562 A1 6/2008 Peveto
2008/0168683 A1 7/2008 Keating
2008/0307673 A1 12/2008 Johnson
2009/0019734 A1 * 1/2009 Reagan ..... A43C 7/00 36/115
2009/0025260 A1 1/2009 Nakano
2010/0011621 A1 * 1/2010 Malka-Harari ..... A43B 3/26 36/97
2010/0101114 A1 * 4/2010 Reagan ..... A43B 3/0031 36/117.1
2010/0115744 A1 * 5/2010 Fong ..... A43C 7/00 24/712.1
2010/0192411 A1 * 8/2010 Leick ..... F16G 11/101 24/713.2
2010/0199522 A1 * 8/2010 Hwang ..... A43B 23/047 36/102
2010/0251572 A1 10/2010 Baudouin et al.
2010/0319216 A1 12/2010 Grenzke et al.
2011/0016751 A1 1/2011 Somerville
2011/0146106 A1 6/2011 Kaufman
2011/0247238 A1 10/2011 Chestnut
2011/0271556 A1 * 11/2011 Dillenbeck ..... A43B 7/144 36/43
2012/0079746 A1 4/2012 Ferreira et al.
2012/0204450 A1 8/2012 Girbaud
2012/0291242 A1 * 11/2012 Donnadieu ..... A43C 11/20 24/712.7
2012/0317839 A1 12/2012 Pratt
2013/0104346 A1 5/2013 Kawaguchi
2013/0185959 A1 7/2013 Coleman
2013/0219747 A1 8/2013 Lederer
2013/0283639 A1 * 10/2013 Williams ..... A43C 7/02 36/83
2014/0000131 A1 1/2014 Meschter et al.
2014/0013624 A1 1/2014 Stockbridge et al.
2014/0096415 A1 4/2014 Long
2014/0115925 A1 5/2014 Hurd et al.
2014/0196317 A1 * 7/2014 Katz ..... A43B 23/07 36/89
2014/0208551 A1 * 7/2014 Ben-Arie ..... A43C 7/04 24/712.9
2014/0250723 A1 9/2014 Kohatsu
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2015/0020416 A1 1/2015 Wiens
2015/0047223 A1 2/2015 Flinterman et al.
2015/0047227 A1 2/2015 Fallon et al.
2015/0096197 A1 4/2015 Salinas
2015/0113834 A1 4/2015 Dojan et al.
2015/0143720 A1 5/2015 Avar
2015/0196095 A1 7/2015 Chapman
2015/0216252 A1 8/2015 Wiens
2015/0289595 A1 10/2015 Rushbrook et al.
2015/0305432 A1 10/2015 Wiens
2015/0305442 A1 10/2015 Ravindran
2015/0374065 A1 12/2015 DiFrancisco
2015/0374527 A1 * 12/2015 Wenger ..... A43C 5/00 602/28
2016/0120264 A1 * 5/2016 Bardini ..... A43C 1/00 36/50.1
2016/0128429 A1 5/2016 Hatfield et al.
2016/0166006 A1 6/2016 DiFrancisco
2016/0242493 A1 8/2016 Stillwagon
2016/0374427 A1 12/2016 Zahabian
2017/0042290 A1 2/2017 Hatfield et al.
2017/0049190 A1 2/2017 Maussen
2017/0079827 A1 * 3/2017 Ostergard ..... A61F 5/0111

(56) References Cited

U.S. PATENT DOCUMENTS

| | | | | |
|---|---|---|---|---|
| 2017/0099906 | A1 | 4/2017 | Figueroa | |
| 2017/0202310 | A1* | 7/2017 | Spanks | A43B 19/00 |
| 2017/0360143 | A1 | 12/2017 | Pratt et al. | |
| 2018/0110287 | A1* | 4/2018 | Hopkins | A43B 13/141 |
| 2018/0110288 | A1 | 4/2018 | Hatfield et al. | |
| 2018/0110289 | A1 | 4/2018 | Owings et al. | |
| 2018/0110292 | A1 | 4/2018 | Beers et al. | |
| 2018/0110295 | A1 | 4/2018 | Dyer et al. | |
| 2018/0116343 | A1* | 5/2018 | Hei | A43C 11/00 |
| 2018/0206588 | A1 | 7/2018 | Pratt et al. | |
| 2018/0213882 | A1 | 8/2018 | Morse | |
| 2018/0213890 | A1 | 8/2018 | Innocente | |
| 2018/0235314 | A1 | 8/2018 | Farage | |
| 2018/0249787 | A1* | 9/2018 | Fuerst, Sr. | A43B 1/04 |
| 2018/0255878 | A1* | 9/2018 | Harris | A43C 7/00 |
| 2018/0263332 | A1 | 9/2018 | Bruno | |
| 2018/0295942 | A1 | 10/2018 | Drake | |
| 2018/0338583 | A1* | 11/2018 | Sullivan | A43B 23/0245 |
| 2018/0352892 | A1* | 12/2018 | Aveni | A43C 9/08 |
| 2019/0000180 | A1* | 1/2019 | Moriyasu | A43B 23/0275 |

FOREIGN PATENT DOCUMENTS

| | | | | |
|---|---|---|---|---|
| CN | 2052208 | U | 2/1990 | |
| CN | 2161101 | Y | 4/1994 | |
| CN | 2262929 | Y | 9/1997 | |
| CN | 2268406 | Y | 11/1997 | |
| CN | 2275814 | Y | 3/1998 | |
| CN | 2281094 | Y | 5/1998 | |
| CN | 2384464 | Y | 6/2000 | |
| CN | 2438353 | Y | 7/2001 | |
| CN | 2456500 | Y | 10/2001 | |
| CN | 2482829 | Y | 3/2002 | |
| CN | 1403041 | A | 3/2003 | |
| CN | 2559235 | Y | 7/2003 | |
| CN | I565297 | A | 1/2005 | |
| CN | 2712118 | Y | 7/2005 | |
| CN | I720835 | A | 1/2006 | |
| CN | 2783792 | Y | 5/2006 | |
| CN | 2819852 | Y | 9/2006 | |
| CN | 1278639 | C | 10/2006 | |
| CN | 1943463 | A | 4/2007 | |
| CN | 2901950 | Y | 5/2007 | |
| CN | 201005111 | Y | 1/2008 | |
| CN | 201157014 | Y | 12/2008 | |
| CN | 201167619 | Y | 12/2008 | |
| CN | 101485505 | A | 7/2009 | |
| CN | 101518380 | A | 9/2009 | |
| CN | 201426430 | Y | 3/2010 | |
| CN | 201504620 | U | 6/2010 | |
| CN | 101500446 | B | 1/2011 | |
| CN | 201743039 | U | 2/2011 | |
| CN | 101986920 | A | 3/2011 | |
| CN | 201831038 | U | 5/2011 | |
| CN | 102159288 | A | 8/2011 | |
| CN | 201967803 | U | 9/2011 | |
| CN | 102256673 | A | 11/2011 | |
| CN | 202211219 | U | 5/2012 | |
| CN | 101991227 | B | 8/2012 | |
| CN | 202819794 | U | 3/2013 | |
| CN | 203121188 | U | 8/2013 | |
| CN | 203137220 | U | 8/2013 | |
| CN | 203841187 | U | 9/2014 | |
| CN | 203884822 | U | 10/2014 | |
| CN | 203913577 | U | 11/2014 | |
| CN | 204070772 | U | 1/2015 | |
| CN | 104394729 | A | 3/2015 | |
| CN | 102595952 | B | 4/2015 | |
| CN | 205040743 | U | 2/2016 | |
| CN | 105876979 | A | 8/2016 | |
| CN | 205512619 | U | 8/2016 | |
| CN | 205568021 | U | 9/2016 | |
| CN | 205658453 | U | 10/2016 | |
| CN | 205671573 | U | 11/2016 | |
| CN | 205795015 | U | 12/2016 | |
| CN | 206025369 | U | 3/2017 | |
| CN | 107692396 | A | 2/2018 | |
| CN | 107921318 | A | 4/2018 | |
| CN | 207544444 | U | 6/2018 | |
| CN | 207949063 | U | 10/2018 | |
| DE | 3310988 | A1 | 9/1984 | |
| DE | 19534249 | A1 | 3/1997 | |
| DE | 19611797 | A1 | 10/1997 | |
| DE | 29809404 | U1 | 8/1998 | |
| DE | 29723911 | U1 | 5/1999 | |
| DE | 10247163 | A1 | 4/2004 | |
| DE | 102004005288 | A1 | 8/2005 | |
| DE | 102009023689 | A1 | 12/2010 | |
| DE | 102013200701 | A1 | 7/2013 | |
| DE | 202016001813 | U1 | 6/2017 | |
| EP | 0570621 | A1 | 11/1993 | |
| EP | 0548116 | B1 | 12/1994 | |
| EP | 0848917 | A1 | 6/1998 | |
| EP | 1059044 | A1 | 12/2000 | |
| EP | 1440627 | A1 | 7/2004 | |
| EP | 1593315 | B1 | 5/2008 | |
| EP | 1952715 | A1 | 8/2008 | |
| EP | 2173208 | B1 | 12/2010 | |
| EP | 2277402 | A2 | 1/2011 | |
| EP | 2490565 | A1 | 8/2012 | |
| EP | 2036449 | B1 | 4/2013 | |
| EP | 2604136 | A1 | 6/2013 | |
| EP | 2606760 | A1 | 6/2013 | |
| EP | 2818068 | A1 | 12/2014 | |
| EP | 2848141 | A1 | 3/2015 | |
| EP | 2937007 | A1 | 10/2015 | |
| FR | 2847129 | A1 | 5/2004 | |
| FR | 2994800 | A1 | 3/2014 | |
| FR | 3023132 | A1 * | 1/2016 | A43B 1/0081 |
| GB | 1154145 | A | 6/1969 | |
| GB | 1358470 | A | 7/1974 | |
| GB | 2517399 | A | 2/2015 | |
| GB | 2533809 | A | 7/2016 | |
| JP | H0181910 | U | 6/1989 | |
| JP | 2001149394 | A | 6/2001 | |
| JP | 2004236860 | A | 8/2004 | |
| JP | 2006055571 | A | 3/2006 | |
| JP | 2007152066 | A | 6/2007 | |
| JP | 2008206629 | A | 9/2008 | |
| JP | 2014176633 | A | 9/2014 | |
| KR | 0090130804 | A | 12/2009 | |
| KR | 20130119566 | A | 11/2013 | |
| NL | 1020208 | C1 | 9/2003 | |
| TW | 585748 | B | 5/2004 | |
| TW | M275736 | U | 9/2005 | |
| TW | 200930315 | A | 7/2009 | |
| TW | 201130440 | A | 9/2011 | |
| TW | M449484 | U | 4/2013 | |
| TW | M469778 | U | 1/2014 | |
| TW | I581730 | B | 5/2017 | |
| WO | 8808678 | A1 | 11/1988 | |
| WO | 9737556 | A1 | 10/1997 | |
| WO | 0076337 | A1 | 12/2000 | |
| WO | 03039283 | A1 | 5/2003 | |
| WO | 2005070246 | A2 | 8/2005 | |
| WO | 2006084185 | A1 | 8/2006 | |
| WO | 2006138170 | A1 | 12/2006 | |
| WO | 2007024875 | A2 | 3/2007 | |
| WO | 2007080205 | A1 | 7/2007 | |
| WO | 2008115743 | A1 | 9/2008 | |
| WO | 2008152414 | A1 | 12/2008 | |
| WO | 2009154350 | A1 | 12/2009 | |
| WO | 2010048203 | A1 | 4/2010 | |
| WO | 2010059716 | A2 | 5/2010 | |
| WO | 2010114993 | A1 | 10/2010 | |
| WO | 2011004946 | A1 | 1/2011 | |
| WO | 2011140584 | A1 | 11/2011 | |
| WO | 2012044974 | A1 | 4/2012 | |
| WO | 2012168956 | A1 | 12/2012 | |
| WO | 2013039385 | A1 | 3/2013 | |
| WO | 2013187288 | A1 | 12/2013 | |
| WO | 2014033396 | A1 | 3/2014 | |
| WO | 2014038937 | A1 | 3/2014 | |
| WO | 2014140443 | A1 | 9/2014 | |

(56) References Cited

FOREIGN PATENT DOCUMENTS

| | | | |
|---|---|---|---|
| WO | 2015002521 | A1 | 1/2015 |
| WO | 2015198460 | A1 | 12/2015 |
| WO | 2016005696 | A1 | 1/2016 |
| WO | 2018092023 | A1 | 5/2018 |
| WO | 2018193276 | A1 | 10/2018 |
| WO | 2018217423 | A1 | 11/2018 |

OTHER PUBLICATIONS

KIZIK Design, KIZIK® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

Nike Ease Challenge Winner Announced, Nike News, Apr. 25, 2017, https://news.nike.com/news/nike-ease-challenge-winner-announced (accessed May 2, 2018).

U.S. Appl. No. 61/260,621, filed Nov. 12, 2009, now U.S. Pat. No. 9,877,542.

U.S. Appl. No. 62/326,650, filed Apr. 22, 2016, now U.S. Pat. No. 9,820,527.

U.S. Appl. No. 62/368,497, filed Jul. 29, 2016, now U.S. Pat. No. 9,820,527.

U.S. Appl. No. 62/486,311, filed Apr. 17, 2017.

* cited by examiner

EASY-ACCESS ARTICLE OF FOOTWEAR WITH CORD LOCK

CROSS-REFERENCE TO RELATED APPLICATION

This application claims the benefit of priority to U.S. Provisional Application No. 62/923,013 filed Oct. 18, 2019, which is hereby incorporated by reference in its entirety.

TECHNICAL FIELD

The present disclosure generally relates to an article of footwear.

BACKGROUND

Traditionally, placing footwear on a foot often requires the use of one or both hands to stretch the ankle opening of a footwear upper, and hold the rear portion during foot insertion. The fit of the upper is then adjusted following foot insertion, such as by tying laces.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
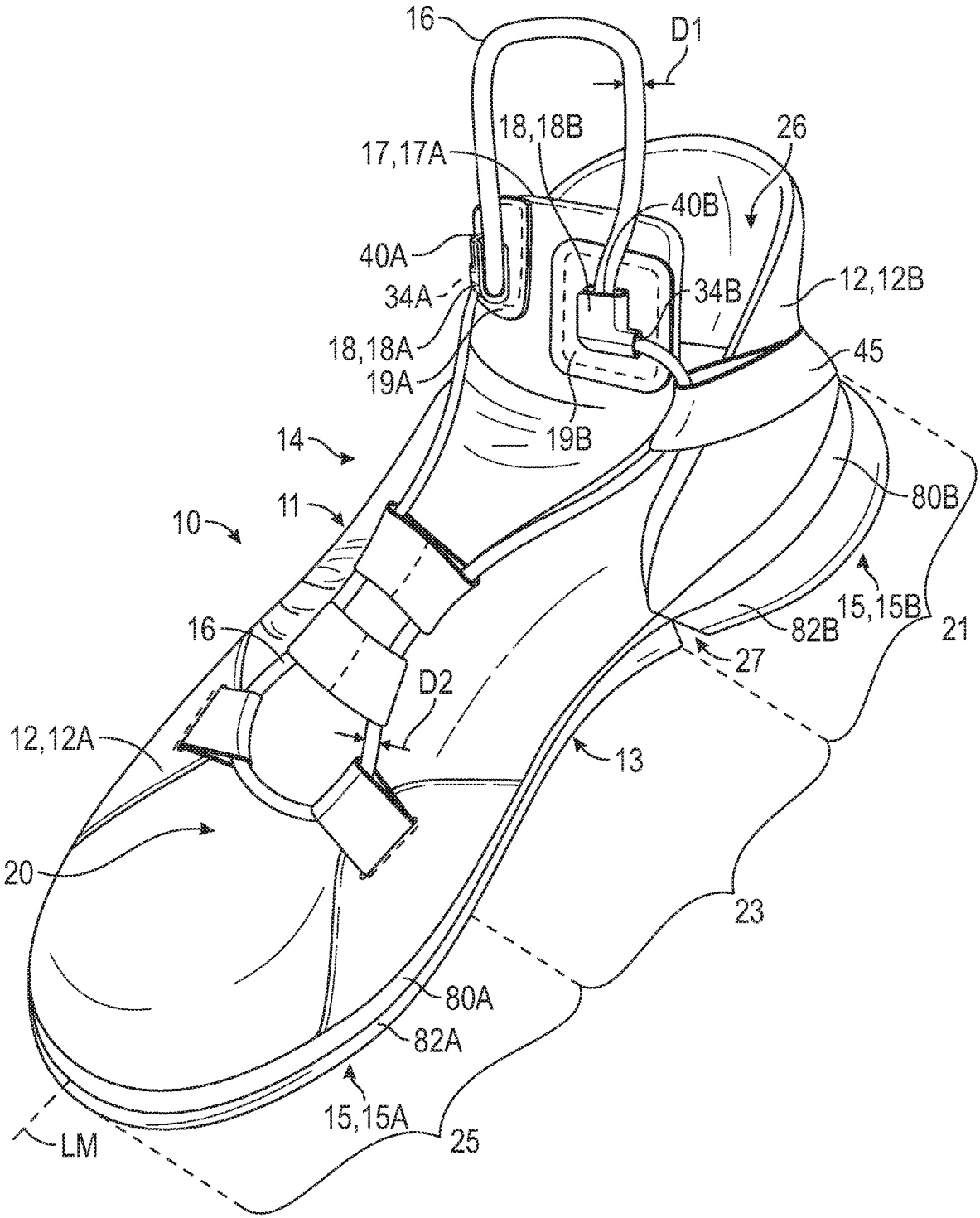
FIG. 1 is a perspective view of an article of footwear in a use position and with an adjustment cord locked to a cord lock.

The present disclosure generally relates to an article of footwear configured for easy access with respect to foot insertion and withdrawal, and also configured for quick and secure adjustment of the fit of the footwear upper to the wearer's foot.

In an example, an article of footwear comprises a sole structure, a footwear upper, and a closure system. The sole structure may have a front sole portion and a rear sole portion, the rear sole portion pivotable relative to the front sole portion between a use position and an access position. The footwear upper may be fixed to the front sole portion and may define a forefoot region of the footwear upper. The closure system may comprise an adjustment cord and a cord lock. The adjustment cord may be operatively secured to the footwear upper at an anchor location. The cord lock may be secured to the footwear upper in a fixed position. The cord lock may interfit with and lock the adjustment cord when the sole structure is in the use position to retain tension in the adjustment cord. For example, the cord lock may be configured so that the adjustment cord slides through the cord lock when under tension to tighten the footwear upper and is repositionable relative to the cord lock to lock to the cord lock and retain tension in the adjustment cord.

In one or more configurations, the footwear upper may be a divided footwear upper including a front upper portion fixed to the front sole portion, and a rear upper portion fixed to the rear sole portion. The rear upper portion may define a heel region of the footwear upper. The closure system may include at least one of a medial strap or a medial hook extending from a medial side of the front upper portion and a lateral strap or a lateral hook extending from a lateral side of the front upper portion. In an embodiment with the medial strap and the lateral strap, the straps may be securable to the rear upper portion to secure the front upper portion to the rear upper portion in the use position.

In a further aspect, the closure system may further comprise at least one of a medial cord guide secured to the medial side of the front upper portion and a lateral cord guide secured to the lateral side of the front upper portion. The adjustment cord may engage the medial cord guide and the lateral cord guide between the anchor location and the cord lock. For example, the medial cord guide may be secured to the medial strap and the lateral cord guide may be secured to the lateral strap. The medial cord guide may be secured to an inner side of the medial strap, and the lateral cord guide may be secured to an inner side of the lateral strap.

In one or more configurations, the cord lock may include a first body secured to a lateral side of a tongue region of the footwear upper, and a second body secured to a medial side of the tongue region of the footwear upper. The second body may be configured symmetrically with the first body about a longitudinal axis of the article of footwear. The adjustment cord may include a loop portion extending from an exit of the first body and from an exit of the second body. In an example, the adjustment cord may be tensioned by pulling the loop portion away from the first body and the second body. Such a configuration enables a user to pull on the loop portion of the adjustment cord extending from the first body to the second body to tighten the cord and the upper attached thereto, and then reposition the loop portion of the cord to lock the cord to the first body and the second body. For example, the looped configuration may allow adjustment (tightening) and locking to be accomplished with one hand.

In one or more configurations, the sole structure may pivot at a transverse axis of the sole structure between the use position and the access position and may be elevated at the transverse axis further away from a ground plane in the access position than in the use position. The rear sole portion may incline from a rear end of the rear sole portion to the transverse axis. The front sole portion may incline from a forward end of the front sole portion to the transverse axis in the access position.

In an aspect, the front sole portion may include a front midsole component and the rear sole portion may include a rear midsole component discontinuous from the front midsole component. The sole structure may include a connecting member connecting the front midsole component to the rear midsole component and defining a groove extending transversely between the front midsole component and the rear midsole component. The front midsole component and the rear midsole component may be pivotable relative to one another at the groove between a use position and an access position. The groove may be relatively open in the use position, and the groove may be relatively closed in the access position.

In one or more configurations, the connecting member may comprise a plate defining the groove and secured to a rear wall of the front midsole component and to a front wall of the rear midsole component at the groove. A rib may be secured at a wall of the connecting member in the groove and may extend outward into the groove. The sole structure may include an outsole with a front portion underlying and secured to the front midsole component forward of the plate, and a rear portion underlying and secured to the rear midsole component rearward of the plate.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 that includes a footwear upper 12 and a closure system 14 (also referred to herein as a tensioning system) configured for quick and easy adjustment of the fit of the upper 12. Moreover, the article of footwear 10 includes a sole structure 15 movable between an access position and a use position as described herein. The closure system 14 is configured to function compatibly with the sole structure 15 such that tensioning of the closure system 14 may also help to secure the footwear 10 in the use position. The article of footwear 10 herein is depicted as an athletic shoe or a leisure shoe, but the present teachings also include an article of footwear that is a work shoe, a dress shoe, a sandal, a slipper, a boot, or any other category of footwear.

As further discussed herein, the sole structure 15 has a front sole portion 15A and a rear sole portion 15B that is pivotable relative to the front sole portion 15A between a use position and an access position for ease of access, as further described herein. The footwear 10 is shown in the use position in FIG. 1. The footwear upper 12 is configured as a divided footwear upper that includes a front upper portion 12A and a rear upper portion 12B. The front upper portion 12A is fixed to the front sole portion 15A and defines a forefoot region 25 of the footwear 10. The rear upper portion 12B is fixed to the rear sole portion 15B and defines a heel region 21 of the footwear 10. In the use position, the front upper portion 12A and the rear upper portion 12B together define an ankle opening 17 that leads into a foot-receiving cavity 26. A wearer's foot (not shown) is disposed in the foot-receiving cavity 26 during use, and the closure system 14 ensures that the footwear upper 12 is secured around the foot with a fit selected by the wearer according to the tension of an adjustment cord 16 which is retained due to a cord lock 18. Alternatively, the front upper portion 12A and the rear upper portion 12B may be portions of a single, unitary, undivided upper. For example, the upper 12 may include gussets, folds, pleats, relatively elastic portions, or the like extending between and connecting the front upper portion 12A and the rear upper portion 12B as a single, unitary upper while still allowing the upper 12 to widen at the ankle opening 17 to the access position.

The article of footwear 10 has the heel region 21, as well as a midfoot region 23 and the forefoot region 25. The heel region 21 generally includes portions of the article of footwear 10 corresponding with rear portions of a human foot, including the calcaneus bone, when the human foot of a size corresponding with the article of footwear 10 is disposed in the foot-receiving cavity 26 and is supported on the sole structure 15. The forefoot region 25 of the article of footwear 10 generally includes portions of the article of footwear 10 corresponding with the toes and the joints connecting the metatarsals with the phalanges of the human foot (interchangeably referred to herein as the "metatarsal-phalangeal joints" or "MPJ" joints). The midfoot region 23 of the article of footwear 10 is disposed between the heel region 21 and the forefoot region 25 and generally includes portions of the article of footwear 10 corresponding with an arch area of the human foot, including the navicular joint. The footwear 10 has a lateral side 11 and a medial side 13 both of which extend from the heel region 21 to the forefoot region 25 and are generally opposite sides of the footwear 10 divided by a longitudinal axis LM, which may be a longitudinal midline of the footwear 10.

Each of the front sole portion 15A and the rear sole portion 15B may include one or more sole components that may be sole layers, such as an outsole and a midsole. The front sole portion 15A is secured to a lower portion of the front upper portion 12A such as by stitching, adhesive or otherwise, and underlies the front upper portion 12A in the use position. The rear sole portion 15B is secured to a lower portion of the rear upper portion 12B such as by stitching, adhesive or otherwise, and underlies the rear upper portion 12B in the use position.

Each of the front sole portion 15A and the rear sole portion 15B may comprise, for example, a midsole of an elastomeric foam such as a polyurethane or ethylvinylacetate foam to attenuate ground reaction forces (e.g., provide cushioning) when compressed between the foot and the ground during walking, running, or other ambulatory activities. In further configurations, the front sole portion 15A and/or the rear sole portion 15B may incorporate fluid-filled chambers, plates, moderators, or other elements that further attenuate forces, enhance stability, or influence the motions of the foot. In the embodiment shown, the front sole portion 15A includes a front midsole component 80A and a front outsole portion 82A secured to the bottom of the front midsole component 80A and wrapping partially up medial and lateral side walls of the front midsole component 80A. The rear sole portion 15B includes a rear midsole component 80B and a rear outsole portion 82B secured to the bottom of the rear midsole component 80B and wrapping partially up medial and lateral side walls of the rear midsole component 80B. The front midsole component 80A is separate and discontinuous from the rear midsole component 80B. Similarly, the front outsole portion 82A is separate and discontinuous from the rear outsole portion 82B. A connecting member 84 (visible, for example, in FIGS. 4 and 6) connects the front midsole component 80A to the rear midsole component 80B and defines a groove 27, as further discussed herein. The connecting member 84 may also be referred to as a plate 84 herein.

The midsole components 80A, 80B may comprise, for example, an elastomeric foam such as a polyurethane or ethylvinylacetate foam to attenuate ground reaction forces (i.e., provide cushioning) when compressed between the foot and the ground during walking, running, or other ambulatory activities. In further configurations, either or both of the midsole components 80A, 80B may incorporate fluid-filled chambers, plates, moderators, or other elements that further attenuate forces, enhance stability, or influence the motions of the foot.

In the embodiment shown, the foam of the cushioning layer (e.g., the midsole components 80A, 80B) may include a foamed polymeric material and may be at least partially a polyurethane (PU) foam or a polyurethane ethylene-vinyl acetate (EVA) foam, and may include heat-expanded and molded EVA foam pellets.

The foamed polymeric material may include one or more polymers. The one or more polymers may include an elastomer, including a thermoplastic elastomer (TPE). The one or more polymers may include aliphatic polymers, aromatic polymers, or mixture of both. In one example, the one or more polymers may include homopolymers, copolymers (including terpolymers), or mixtures of both. The copolymers may be random copolymers, block copolymers, alternating copolymers, periodic copolymers, or graft copolymers, for instance. The one or more polymers may include olefinic homopolymers or copolymers or a mixture of olefinic homopolymers and copolymers. Examples of olefinic polymers include polyethylene (PE) and polypropylene (PP). For example, the PE may be a PE homopolymer such as a low density PE or a high density PE, a low molecular weight PE or an ultra-high molecular weight PE, a linear PE or a branched chain PE, etc. The PE may be an ethylene copolymer such as, for example, an ethylene-vinyl acetate (EVA) copolymer, an ethylene-vinyl alcohol (EVOH) copolymer, an ethylene-ethyl acrylate copolymer, an ethylene-unsaturated mono-fatty acid copolymer, etc. The one or more polymers may include a polyacrylate such as a polyacrylic acid, an ester of a polyacrylic acid, a polyacrylonitrile, a polyacrylic acetate, a polymethyl acrylate, a polyethyl acrylate, a polybutyl acrylate, a polymethyl methacrylate, a polyvinyl acetate, etc., including derivatives thereof, copolymers thereof, and any mixture thereof, in one example. The one or more polymers may include an ionomeric polymer. The ionomeric polymer may be a polycarboxylic acid or a derivative of a polycarboxylic acid, for instance. The ionomeric polymer may be a sodium salt, a magnesium salt, a potassium salt, or a salt of another metallic ion. The ionomeric polymer may be a fatty acid modified ionomeric polymer. Examples of ionomeric polymers include polystyrene sulfonate, and ethylene-methacrylic acid copolymers. The one or more polymers may include a polycarbonate. The one or more polymers may include a fluoropolymer. The one or more polymers may include a polysiloxane. The one or more polymers may include a vinyl polymer such as polyvinyl chloride (PVC), polyvinyl acetate, polyvinyl alcohol, etc. The one or more polymers may include a polystyrene. The polystyrene may be a styrene copolymer such as, for example, an acrylonitrile butadiene styrene (ABS), a styrene acrylonitrile (SAN), a styrene ethylene butylene styrene (SEBS), a styrene ethylene propylene styrene (SEPS), a styrene butadiene styrene (SBS), etc. The one or more polymers may include a polyamide (PA). The PA may be a PA 6, PA 66, PA 11, or a copolymer thereof. The polyester may be an aliphatic polyester homopolymer or copolymer such as polyglycolic acid, polylactic acid, polycaprolactone, polyhydroxybutyrate, and the like. The polyester may be a semi-aromatic copolymer such as polyethylene terephthalate (PET) or polybutylene terephthalate (PBT). The one or more polymers may include a polyether such as a polyethylene glycol or polypropylene glycol, including copolymers thereof. The one or more polymers may include a polyurethane, including an aromatic polyurethane derived from an aromatic isocyanate such as diphenylmethane diisocyanate (MDI) or toluene diisocyanate (TDI), or an aliphatic polyurethane derived from an aliphatic isocyanate such as hexamethylene diisocyanate (HDI) or isophone diisocyanate (IPDI), or a mixture of both an aromatic polyurethane and an aliphatic polyurethane.

The foamed polymeric material may be a chemically foamed polymeric material, which is foamed using a chemical blowing agent that forms a gas when heated. For example, the chemical blowing agent can be an azo compound such as adodicarbonamide, sodium bicarbonate, or an isocyanate. Alternatively or additionally, the foamed polymeric material may be a physically foamed polymeric material, which is foamed using a physical blowing agent which changes phase from a liquid or a supercritical fluid to a gas due to changes in temperature and/or pressure. Optionally, in addition to the one or more polymers, the polymeric material may further include one or more fillers such as glass fiber, powdered glass, modified or natural silica, calcium carbonate, mica, paper, wood chips, modified or natural clays, modified or unmodified synthetic clays, talc, etc. Similarly, the polymeric material optionally may further include one or more colorants, such as pigments or dyes. Other optional components of the polymeric material include processing aids, ultra-violet light absorbers, and the like.

The foamed polymeric material may be a crosslinked foamed polymeric material, i.e., a foamed material in which covalent crosslinking bonds exist between at least a portion of the one or more polymers. A crosslinked foamed polymeric material can be formed by including a crosslinking agent in the polymeric material used to form the foam. The crosslinking agent can be a peroxide-based crosslinking agent such as dicumyl peroxide. Alternatively, the foamed polymeric material can be an uncrosslinked foamed polymeric material which has thermoplastic properties. The foamed polymeric material may be an elastomeric foamed material.

The midsole components 80A, 80B may each comprise one or more bladder elements that may be blow-molded or formed from polymeric sheets that may comprise a variety of materials including various polymers that can resiliently retain a fluid such as air or another gas. Examples of polymer materials for the polymeric sheets include thermoplastic urethane, polyurethane, polyester, polyester polyurethane, and polyether polyurethane. Moreover, the polymeric sheets can each be formed of layers of different materials. In one embodiment, each polymeric sheet is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets are disclosed in U.S. Pat. Nos. 4,183,156 and 4,219,945 to Rudy which are incorporated by reference in their entireties. Further suitable materials for the polymeric sheets include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets, engineering properties such as tensile strength, stretch properties, fatigue characteristics, dynamic modulus, and loss tangent can be considered. The thicknesses of polymeric sheets can be selected to provide these characteristics.

The front outsole portion 82A and/or the rear outsole portion 82B may be formed from materials that may generally include natural or synthetic rubber or other suitably durable materials. The material or materials for the outsole portions may be selected to provide a desirable combination of durability and flexibility. Synthetic rubbers that may be used include ethylene propylene rubber (EPR), styrene isoprene styrene (SIS) copolymer rubber, and styrene butadiene rubber. The outsole portions 82A, 82B may be a harder material than the midsole components 80A, 80B, such as a natural or synthetic rubber or composite including rubber, with a hardness greater than the hardness of the midsole components 80A, 80B. Alternatively, the outsole portions 82A, 82B may be natural or synthetic leather or another material. Hardness may be measured according to any suitable scale for measuring the hardness of foams and rubber, such as a Shore A or Shore D scale, and according to any associated durometer test method. Fatigue life and environmental testing may be used to select appropriate materials for the outsole portions 82A, 82B. The ability of the outsole portions 82A, 82B to bond to the midsole components 80A, 80B may also be considered in selecting materials for the outsole portions 82A, 82B.

The closure system 14 includes the adjustment cord 16 and the cord lock 18. The adjustment cord 16 is operatively secured to the front upper portion 12A at an anchor location 20. The cord lock 18 is also secured to the front upper portion 12A in a fixed position so that the cord lock 18 does not move relative to the front upper portion 12A. More particularly, the cord lock 18 includes a first body 18A and a second body 18B both fixed at a tongue region of the front upper portion 12A, as further discussed herein. The cord lock 18 interfits with and locks the adjustment cord 16. In the embodiment shown, the cord lock 18 is configured so that the adjustment cord 16 slides through the cord lock 18 when under tension to tighten the footwear upper 12, and is pivotable relative to the cord lock 18 from a first position shown in FIG. 2 (referred to as an unlocked or untensioned position) to a second position shown in FIG. 1 (referred to as a locked position) to lock to the cord lock 18 and retain tension in the adjustment cord 16. Adjustment is made by simply pulling a loop portion 16A of an adjustment cord 16 to tension the cord 16 and pivoting the loop portion 16A of the cord from the first position to the second position. The loop portion 16A is continuous with a remaining portion 16B of the cord 16. The loop portion 16A is that portion that extends from a first exit opening 24A of the first body 18A to a first exit opening 24B of the second body 18B. The adjustment cord 16 may be tensioned by pulling the loop portion 16A away from the first body 18A and the second body 18B as further discussed herein.

Pulling the loop portion 16A concurrently pulls or cinches the front upper portion 12A to adjust its fit over the foot of a wearer. Moving the loop portion 16A to the second position while maintaining the pulling force locks the cord 16 to the lock 18, which retains tension in the cord 16 when the pulling force is then removed. As used herein, an adjustment cord such as adjustment cord 16 is a flexible, resiliently elastic or inelastic, elongated tensile element, and is a structure capable of withstanding a tensile load and may include, but is not limited to, a lace, a strand, a wire, a cord, a thread, or a string, among others. A loop portion such as loop portion 16A is a portion that is continuous and may form a curve but need not be circular or semicircular. For example, a loop portion may be configured as two ends secured to one another. In other embodiments, the portion 16A need not be a continuous loop, and may instead include a portion at a medial end of the cord 16 extending through the first body 18A, and a portion at a lateral end of the cord 16 extending through the second body 18B.

Figure 3:
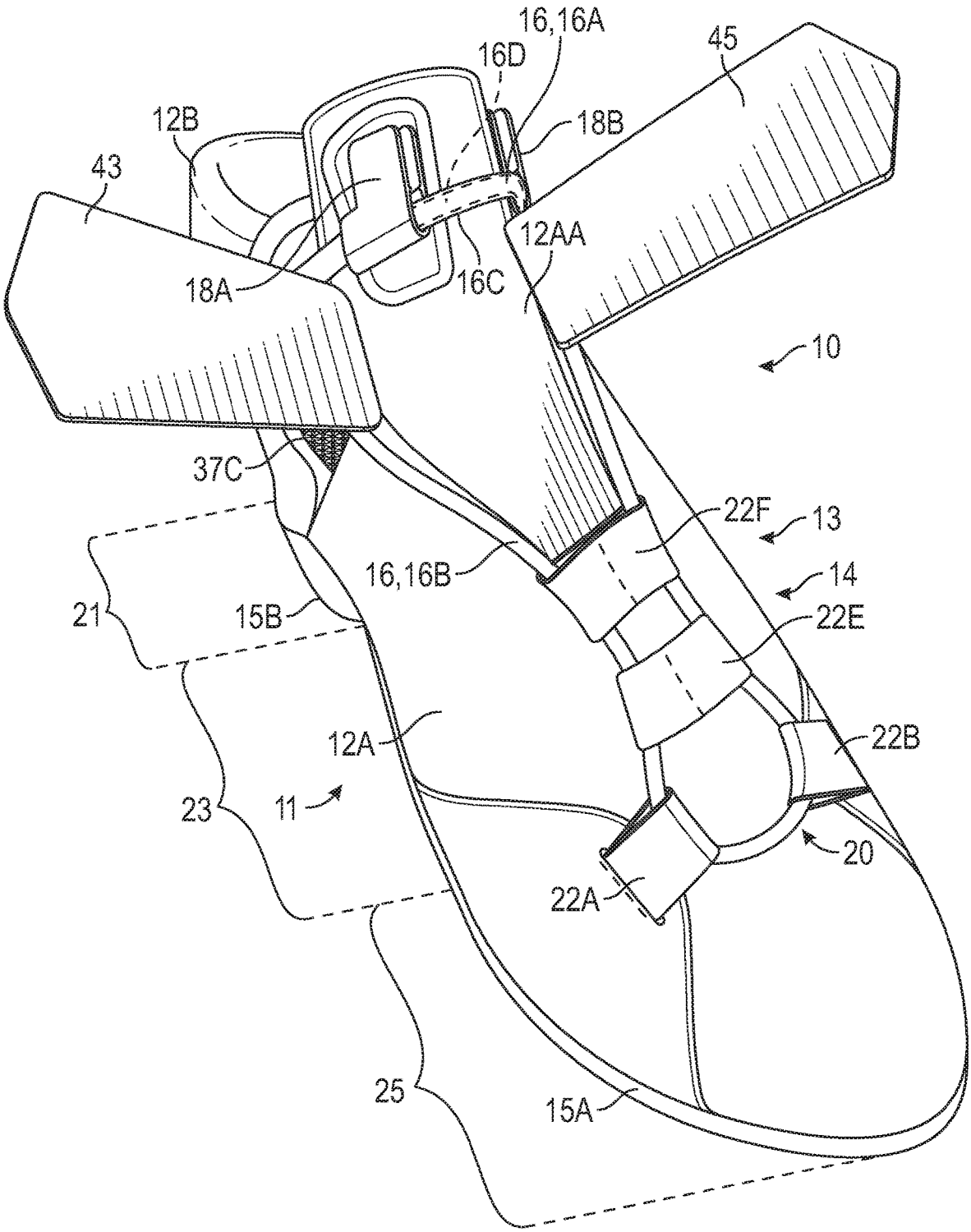
FIG. 3 is another perspective view of the article of footwear in an access position with the adjustment cord unlocked and lateral and medial straps unfastened.

In some embodiments, the cord 16 may be an elastic cord that resiliently stretches to a greater overall length and reduced thickness when tensioned by pulling on the loop portion 16A, and then returns to a greater thickness and shorter overall length when tension is released. As shown in FIG. 3, the cord 16 may include an elastic core 16D of rubber or other resiliently stretchable material surrounded by a woven sheath 16C. The elastic core 16D may be slidable within and relative to the sheath 16C. The sheath 16C may be loosely woven or otherwise configured so that it may also stretch to a greater length as the cord 16 is tensioned. In other embodiments, the cord 16 may be an inelastic material. For example, an inelastic cord 16 may be tensioned and may lock to the lock 18 by a friction fit, such as by compressing when manually pushed into the lock 18.

In the tensioned and locked state of FIG. 1, the cord 16 locks to the bodies 18A, 18B so that the portion 16B of the cord 16 extending between entrance openings 34A, 34B of the bodies 18A, 18B remains tensioned and, if elastic, may have a slightly lesser thickness or diameter D2 than the loop portion 16A, indicating that it is tensioned in the locked position and the loop portion 16A is not.

Figure 2:
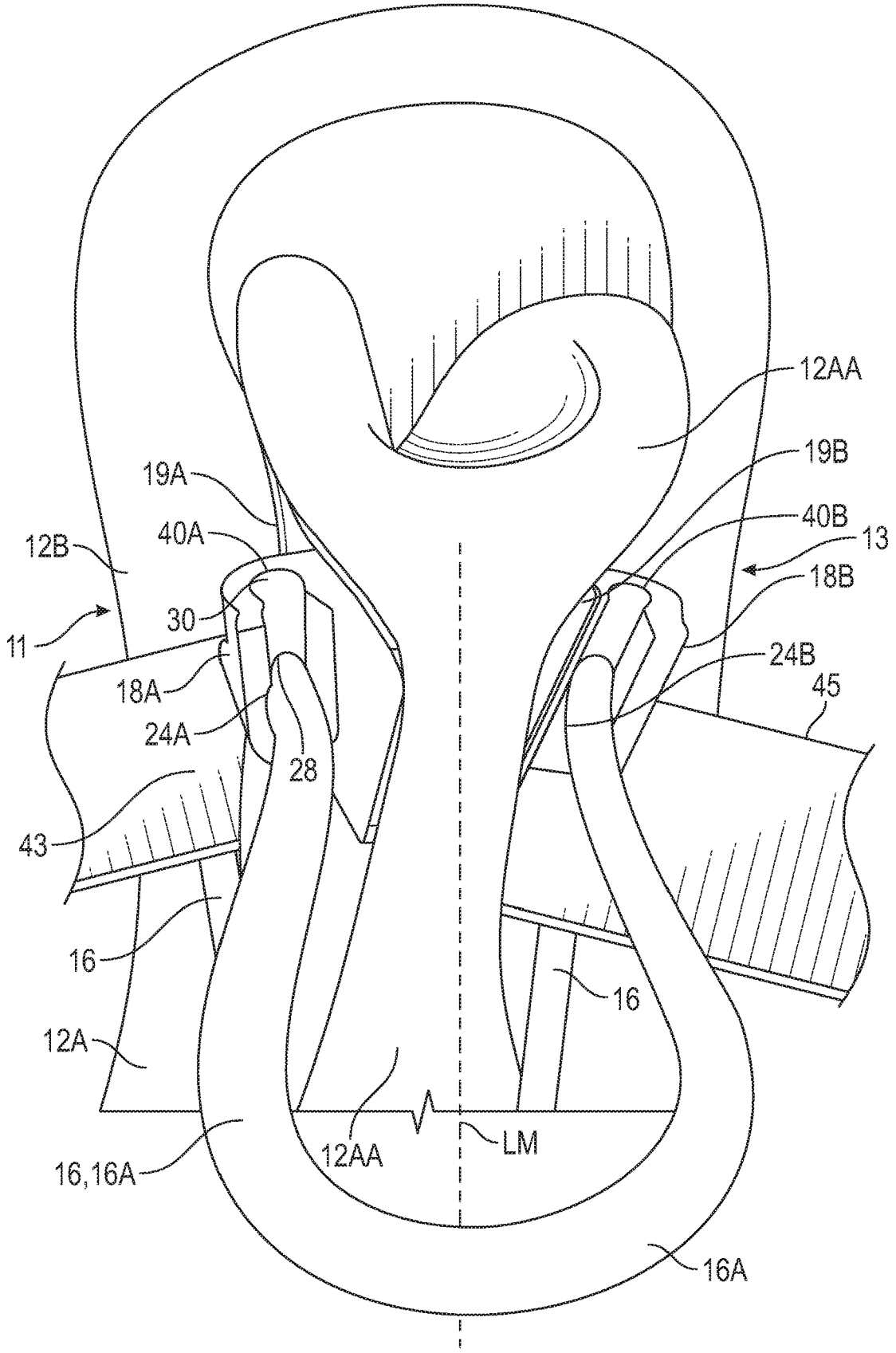
FIG. 2 is a fragmentary perspective view of the article of footwear of FIG. 1 with the adjustment cord unlocked and in an untensioned state.

As best shown in FIG. 2, the closure system 14 also includes a medial strap 45 extending from the medial side 13 of the front upper portion 12A and a lateral strap 43 (shown in FIG. 2) extending from the lateral side 11 of the front upper portion 12A. As discussed with respect to FIGS. 7 and 8, the medial strap 45 and the lateral strap 43 are securable to the rear upper portion 12B to secure the front upper portion 12A to the rear upper portion 12B in the use position. For example, the straps 43,45 may secure to the rear upper portion 12B via hook-and-loop fastener components or other types of fastener components as further discussed herein.

As shown in FIG. 2, the cord lock 18 includes a first body 18A and a second body 18B. The first body 18A is secured to a lateral side 11 of the front upper portion 12A at a tongue region 12AA of the front upper portion 12A. The second body 18B is secured to a medial side 13 of the front upper portion 12A at the tongue region 12AA. The second body 18B is configured symmetrically with the first body 18A about a longitudinal axis LM of the article of footwear 10, such as the longitudinal midline. The first and second bodies 18A, 18B are mirror images of one another, and are spaced apart from one another on the tongue region 12AA. Each body 18A, 18B includes a flange 19A, 19B, respectively. The flange 19A is integral with the first body 18A, and the flange 19B is integral with the second body 18B, each as a unitary, one-piece component. In other embodiments, the bodies 18A, 18B may be secured to the respective flanges 19A, 19B to be made integral therewith. For example, the bodies 18A, 18B and flanges 19A, 19B may include a thermoplastic material such as Nylon 12 (PA), also referred to as Nylon polyamide 12 or Nylon (PA12) available from Arkema Inc. in King of Prussia, Pa. USA. Additionally, the thermoplastic material may be reinforced, such as with glass, or may not be reinforced. As another alternative, the bodies 18A, 18B and flanges 19A, 19B may include a molded rubber material. The flanges 19A, 19B are stitched, adhered, thermally bonded, or otherwise secured to the tongue region 12AA.

FIG. 3 shows the article of footwear 10 in the access position, with the rear sole portion 15B mostly hidden due to foreshortening in the front perspective view in which the heel region 21 appears smaller than the forefoot region 25. In FIG. 3, the cord 16 is elastic and is shown in an untensioned state, as is apparent by the generally equal and uniform thickness of a portion 16B of the cord 16 extending through the cord guides 22A-22D, and a portion 16A of the cord 16 extending from a first exit opening 24A of the first body 18A to a first exit opening 24B of the second body 18B. The portion 16A is referred to herein as the loop portion. The portion 16B extends from the anchor location 20 to an entrance opening 34A (see FIG. 7) of the body 18A, and to an entrance opening 34B (see FIG. 8) of the second body 18B. In the untensioned state, the elastic core portion of cord 16 may have a uniform thickness or diameter D1 both in the loop portion 16A and in the remaining portion 16B. The overall thickness of the loop portion 16A may appear larger due to bunching of the sheath 16C covering the elastic core 16D. The cord 16 may be hollow, solid, or stranded core cable. The cord 16 may have a circular cross-section of diameter D1 (see FIG. 1) or may have a non-circular cross-section with a cross-sectional area equal to that of a circular cross-section of D1. For example, the cord 16 may be round with a round cross-section, or may be flat with a rectangular cross-section, or may have another cross-sectional shape. In embodiments in which the cord 16 is flat, for example, it may be manually folded along its length at the loop portion 16A before it is repositioned into the cord lock 18. Such a flat cord 16 may be elastic or inelastic.

In FIG. 3, the adjustment cord 16 is untensioned and the lateral strap 43 and the medial strap 45 are unfastened. The closure system 14 includes forefoot cord guides 22A, 22B anchored to the front upper portion 12A in the forefoot region 25. The adjustment cord 16 is operatively secured to the front upper portion 12A at an anchor location 20. For example, the anchor location 20 is the area on the front upper portion 12A where lateral forefoot cord guide 22A and medial forefoot cord guide 22B are stitched or otherwise secured to the front upper portion 12A. The cord guides 22A, 22B are sleeves through which the cord 16 extends. The medial forefoot cord guide 22B is secured to the medial side 13 of the front upper portion 12A in the forefoot region 25. The lateral forefoot cord guide 22A is secured to the lateral side 11 of the front upper portion 12A in the forefoot region 25. Accordingly, the cord 16 is operatively secured to the outer surface of the front upper portion 12A at the anchor location 20 in an indirect manner via the cord guides 22A, 22B through which the cord 16 may slide.

Alternatively, the cord 16 could be stitched or otherwise operatively secured directly to the front upper portion 12A such that it is fixed to the front upper portion 12A at the anchor location in a manner in which it is not slidable relative to the front upper portion 12A at the anchor location 20.

Figure 6:
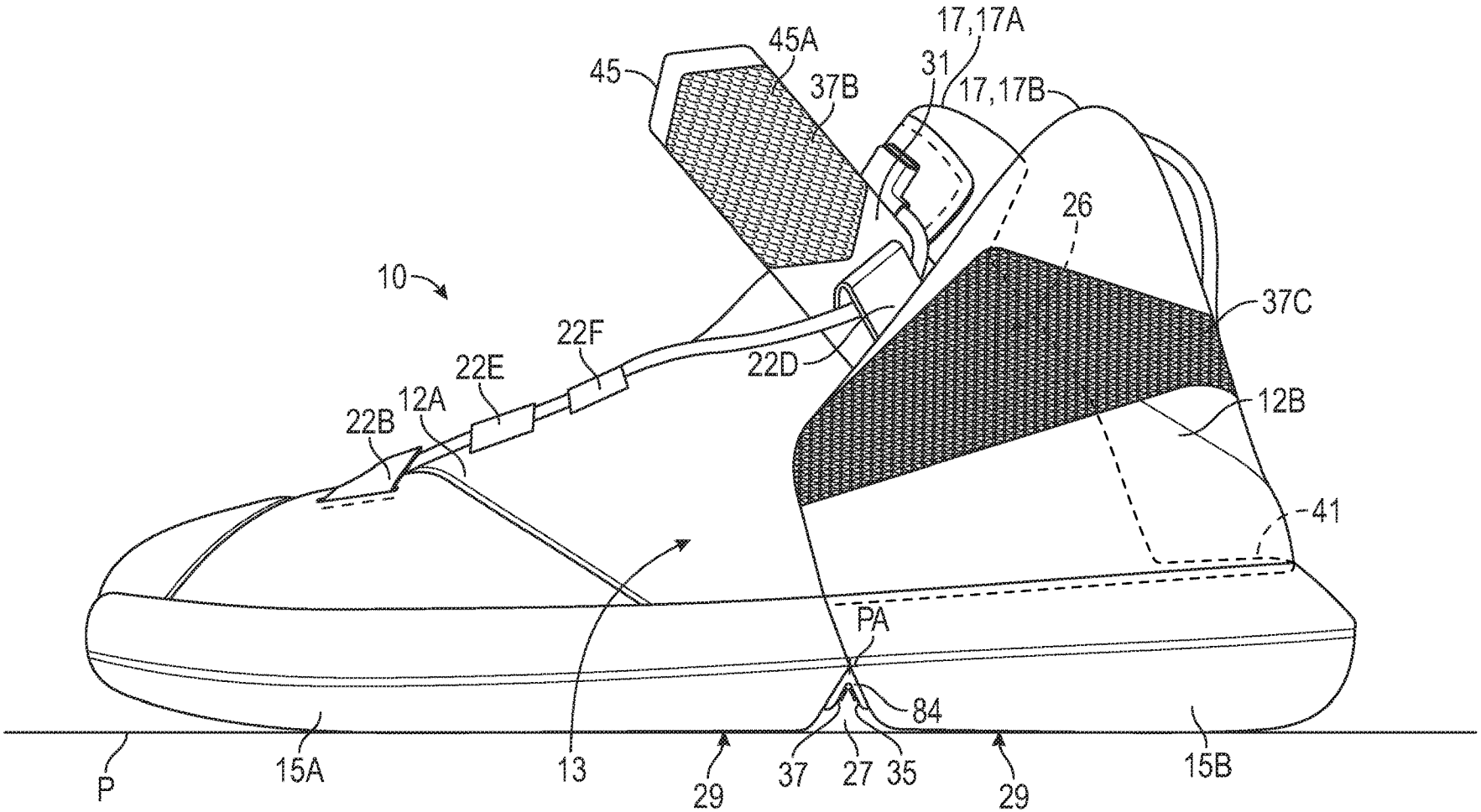
FIG. 6 is a medial side view of the article of footwear in the use position with the adjustment cord unlocked and the lateral and medial straps unfastened.

The closure system 14 also includes a lateral cord guide 22C secured to the lateral side 11 of the front upper portion 12A (see FIG. 4) and a medial cord guide 22D secured to the medial side 13 of the front upper portion 12A (see FIG. 6). The adjustment cord 16 engages the medial cord guide 22D and the lateral cord guide 22C between the anchor location 20 and the cord lock 18. The medial cord guide 22D is secured to an inner side 45A the medial strap 45 and the lateral cord guide 22C is secured to the inner side 43A of the lateral strap 43. The cord 16 engages the cord guides 22A-22D when the cord 16 is tensioned by pulling loop portion 16A. Referring again to FIG. 3, the closure system 14 may further include at least one additional cord guide (such as cord guide 22E and/or cord guide 22F) that is secured to the front upper portion 12A, with the adjustment cord 16 engaging the additional cord guide 22E and/or 22F between the forefoot cord guides 22A, 22B and the cord lock 18. The cord guides 22A-22F are depicted as flexible but relatively non-elastic loops, and may be a woven or mesh nylon material, or may be other materials or configurations such as webbing, rigid hooks, or eyelets.

Figure 4:
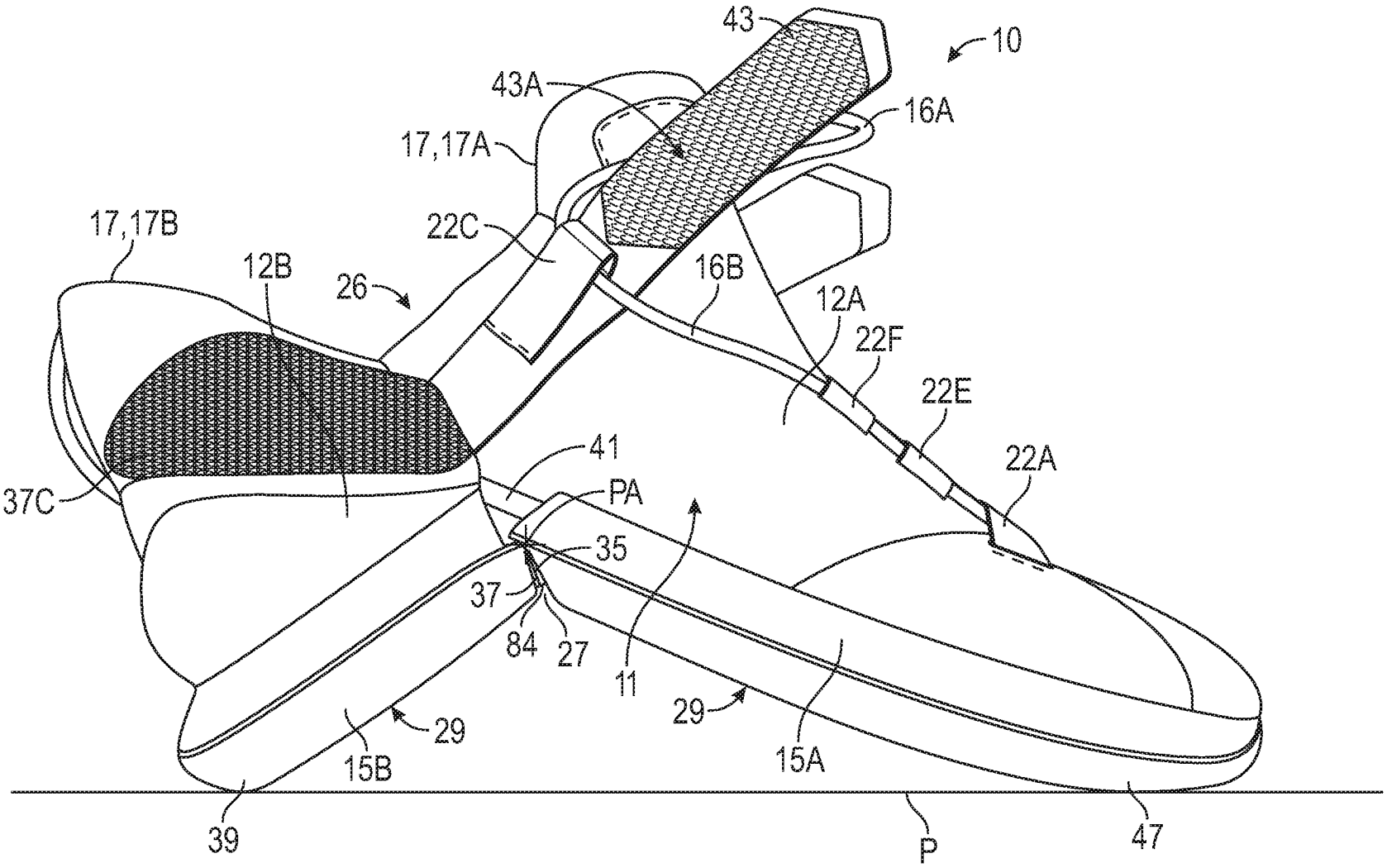
FIG. 4 is a lateral side view of the article of footwear in the access position with the adjustment cord unlocked and the lateral and medial straps unfastened.

Referring to FIG. 4, the sole structure 15 is shown pivoted about a transverse pivot axis PA from the use position of FIG. 1 to an access position. The transverse pivot axis PA extends transversely across the sole structure 15 (e.g., from the lateral side 11 to the medial side 13) over the groove 27 defined by the connecting member 84. The groove 27 extends across a bottom surface 29 of the sole structure 15 between the front sole portion 15A and the rear sole portion 15B. The groove 27 is best shown in FIG. 6 and extends from the lateral side 11 to the medial side 13 of the sole structure 15. The groove 27 is relatively closed in the access position, enabling the sole structure 15 to be elevated at the transverse axis PA, e.g., further above a ground plane P in the access position than in the use position. In the use position (shown best in FIG. 6), the groove 27 is relatively open, and a front wall 35 of the connecting member 84 is further from a rear wall 37 of the connecting member 84 than in the closed position. Stated differently, confronting surfaces (e.g., the walls 35, 37) of the connecting member 84 are further from one another in the open position than in the closed position.

The peak of the groove 27 or top of the cross-section through the groove 27 is configured to permit flexing of the material of the connecting member 84 for opening and closing of the groove 27 while minimizing or reducing stress concentrations or fatigue. For example, if a top of the groove 27 extends from the lateral side 11 to the medial side 13 of the sole structure 15, then internal forces resulting from the flexing are spread across the width of the sole structure 15, reducing stress concentrations in the connecting member 84. Additionally, if the top of the groove 27 has a relatively rounded rather than a relatively pointed shape (e.g., does not have a pointed apex), internal forces are spread over a greater area of the material, reducing stress concentrations in comparison to a pointed groove.

In the access position of FIG. 4, the rear sole portion 15B inclines from a rear end 39 of the rear sole portion 15B to the transverse axis PA and the front sole portion 15A inclines from a forward end 47 of the front sole portion 15A to the transverse axis PA. In the access position, the front upper portion 12A and the rear upper portion 12B are spaced apart from one another so that the ankle opening 17 is larger than in the use position. More specifically, a front 17A of the ankle opening 17 (as defined by the tongue region 12AA) is further from a rear 17B of the ankle opening 17 (as defined by the rear upper portion 12B). In the use position of FIG. 6, the front 17A is closer to the rear 17B than in the access position so that the ankle opening 17 snugly fits around the wearer's ankle. In FIG. 6, the footwear 10 is shown without a foot disposed therein. Because the upper 12 is comprised of relatively stretchable and flexible material or materials around the ankle, the ankle opening 17 appears slightly smaller than it would when stretched around an ankle.

Figure 5:
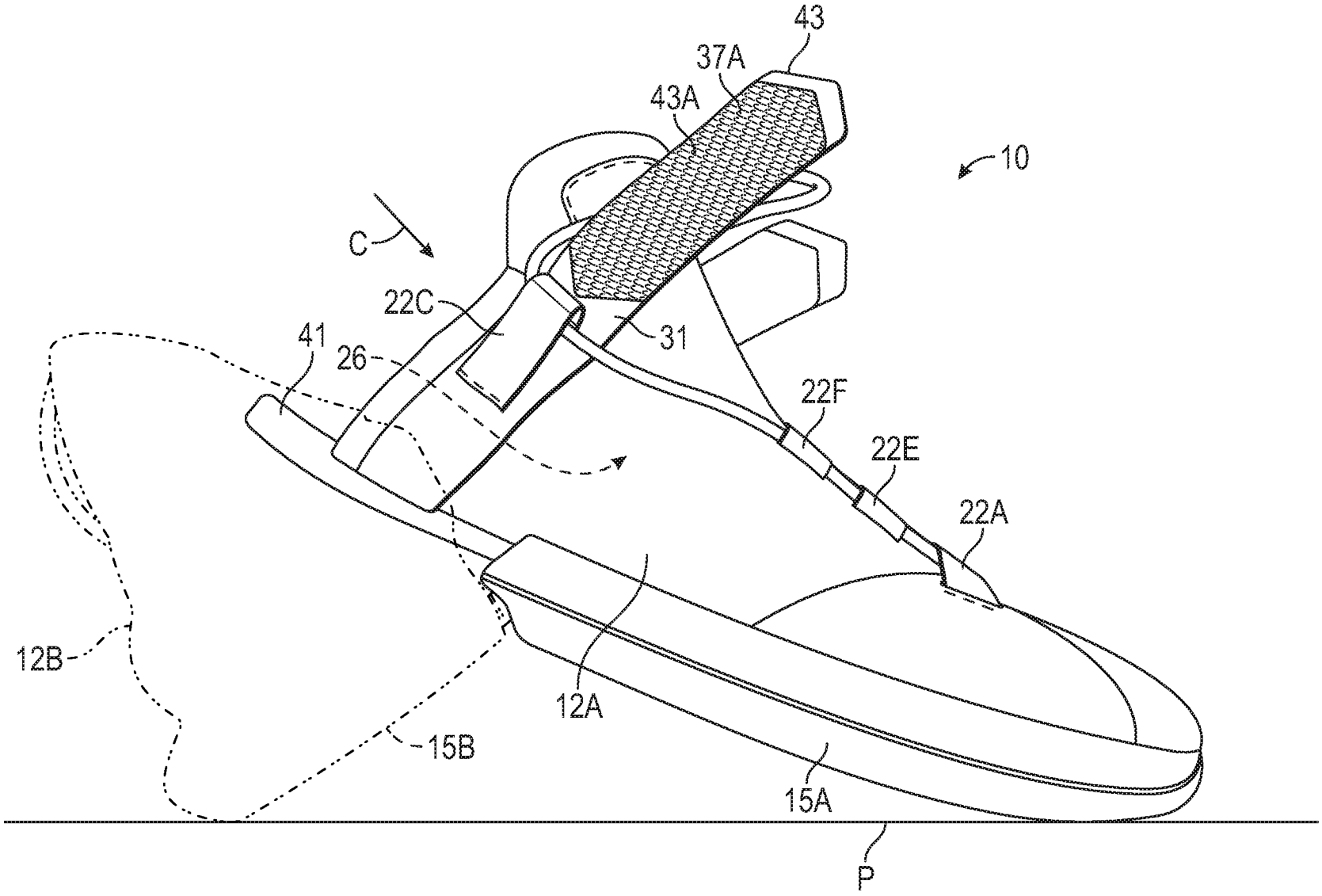
FIG. 5 is a lateral side view of the article of footwear in the access position with the adjustment cord unlocked and the lateral and medial straps unfastened and with a rear upper portion and a rear sole portion in phantom.

FIG. 5 shows the footwear 10 in the access position as described with respect to FIG. 4 but shows the rear upper portion 12B and the rear sole portion 15B in phantom so that a heel footbed 41 that extends rearward from the front sole portion 15A is visible. When the footwear 10 is in the use position of FIG. 6 with the front sole portion 15A and the rear sole portion 15B pivoted back downward from the access position to rest relatively level on the ground plane P (rather than elevated at the transverse axis PA), the heel footbed 41 extends rearward over and rests on the rear sole portion 15B. The heel footbed 41 is shown in hidden lines in this position in FIG. 6. When in the access position of FIG. 5, the heel footbed 41 serves as a visual target for a person inserting a foot into the foot-receiving cavity 26 of the front upper portion 12A and the front sole portion 15A. A person will typically insert the foot forward and downward in the direction of arrow C toward the foot-receiving cavity 26. When the sole of the foot exerts downward force on the front sole portion 15A, including on the heel footbed 41, the foot will be guided correctly into position on the heel footbed 41 onto the top side of the rear sole portion 15B with the rear upper portion 12B wrapping around the rear of the wearer's heel. Properly placing the foot on the heel footbed 41 helps ensure correct alignment of the foot over the front sole portion 15A so that when the sole structure 15 pivots downward to the use position under the weight of the wearer, the rear upper portion 12B will easily slip around the rear of the wearer's foot.

Figure 7:
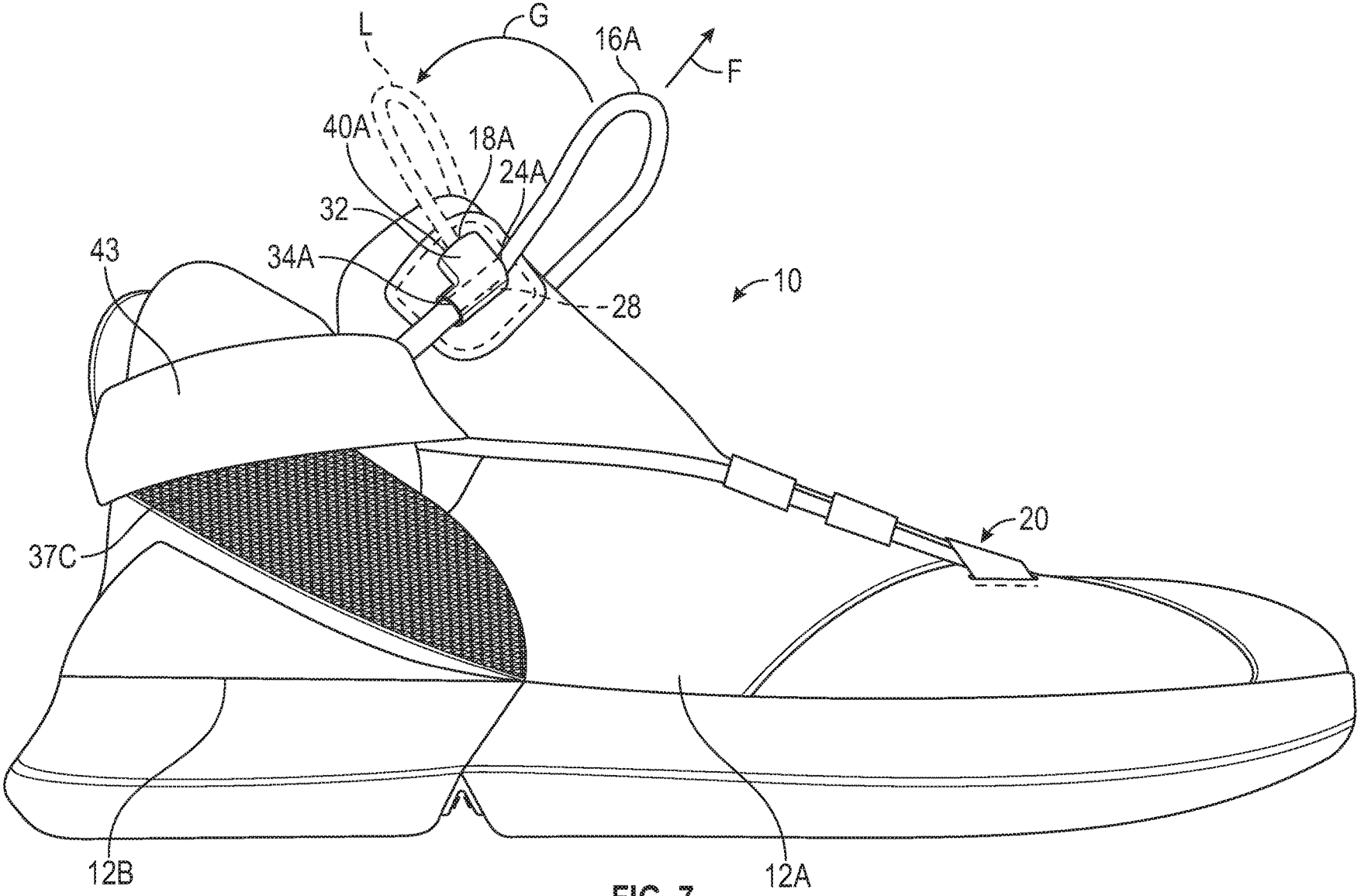
FIG. 7 is a lateral side view of the article of footwear in the use position with the adjustment cord unlocked and the lateral and medial straps fastened.
Figure 8:
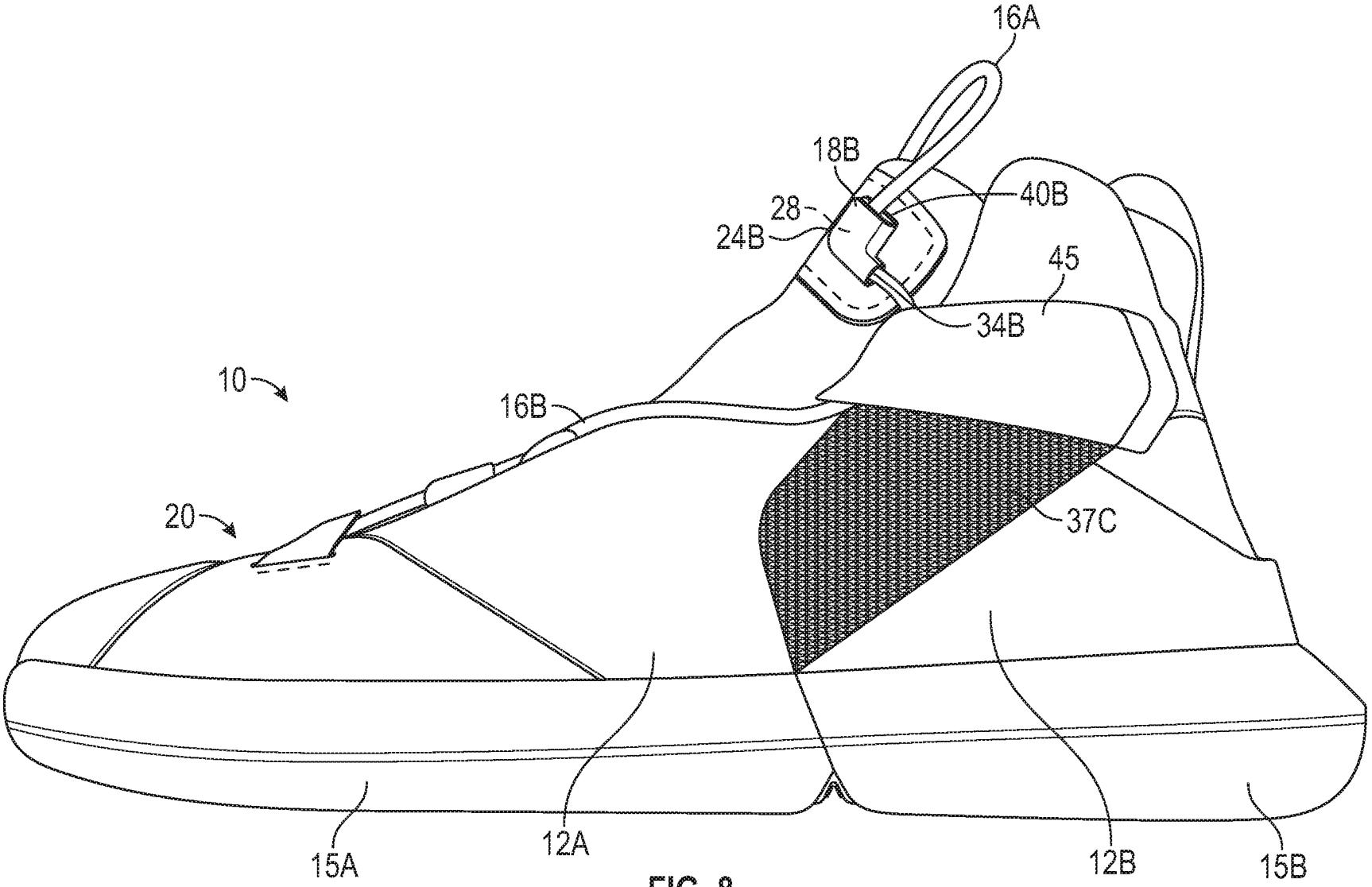
FIG. 8 is a medial side view of the article of footwear in the use position with the adjustment cord locked and the lateral and medial straps fastened.

FIGS. 5 and 6 show the lateral cord guide 22C secured to the inner side 43A of the lateral strap 43 (FIG. 5) and the medial cord guide 22D secured to the inner side 45A of the medial strap 45 (FIG. 6). Lower portions of the straps 43, 45 are secured to the front upper portion 12A, such as by stitching, and the cord guides 22C, 22D are secured to these lower portions at the inner sides of the straps 43, 45, respectively. The cord guides 22C and 22D are looped sleeves that allow the cord 16 to slide through a space between the cord guide and the front upper portion 12A. The adjustment cord 16 engages the medial cord guide 22D and the lateral cord guide 22C between the anchor location 20 and the cord lock 18. When upper portions of the straps 43,45 are secured to the rear upper portion 12B as shown in FIGS. 7 and 8, the cord guides 22C and 22D and the cord 16 are disposed between the inner sides 43A, 45A of the respective straps 43 and 45 and the front upper portion 12A. The straps 43,45 may each have a resiliently stretchable portion 31 adjacent the fastener components 37A, 37B (described below) and the cord guides 22C, 22D, which enables further tightening of the front upper portion 12A to the rear upper portion 12B when the straps 43, 45 are stretched. Additionally, the cord 16 may be slightly further rearward when the straps 43, 45 are stretched at the resiliently stretchable portions 31 and secured to the rear upper portion 12B. The cord 16 follows a non-linear path from the anchor location 20 at the cord guides 22A, 22B through the cord guides 22C, 22D to the lock bodies 18A, 18B.

At least one fastener component 37A is secured to the inner side 43A of strap 43, and at least one fastener component 37B is secured to the inner side 45A of strap 45. To retain the footwear 10 in the use position, the fastener components 37A, 37B are releasably securable to one or more complementary fastener components 37C that are secured to the rear upper portion 12B. FIG. 7 shows the lateral side strap 43 secured to the rear upper portion 12B at the fastener component 37C. FIG. 8 shows the medial strap 45 secured to the rear upper portion 12B at the fastener component 37C. In the embodiments shown the fastener components 37A, 37B, 37C are hook and loop fasteners. For example, the fastener components 37A, 37B may be include a plurality of loops, and the fastener component 37C may include a plurality of hooks to which the loops are securable. Alternatively, the fastener components 37A, 37B could include a plurality of hooks and the fastener component 37C may include a plurality of loops. In another alternative, each of the fastener components 37A, 37B, 37C could include both hooks and loops configured so that the fastener components 37A and 37B can secure to the fastener component 37C. The fastener component 37C is shown as a single, continuous fastener component extending around the rear of the rear upper portion 12B and on both the lateral side 11 and medial side 13 of the rear upper portion 12B. This large expanse of the fastener component 37C allows the straps 43, 45 to be secured at various locations on the fastener component 37C to affect, in combination with the adjustment cord 16 and lock 18, a desired fit of the upper 12 (e.g., upper portions 12A, 12B) to the foot. In other embodiments, multiple smaller and discrete fastener components 37C may be secured to the rear upper portion 12B instead of one large, continuous fastener component 37C. Tensioning of the adjustment cord 16 when the lateral strap 43 and the medial strap 45 are secured to the rear upper portion 12B may also further pull the rear upper portion 12B toward the front upper portion 12A due to the engagement of the cord 16 with the lateral cord guide 22C and the medial cord guide 22D at the inner sides 45A, 43A of the medial strap 45 and the lateral strap 43.

The cord 16 may be tensioned by pulling on the loop portion 16A and then may be locked to the cord lock 18 to retain the tension. Tensioning and locking may occur either before or after securing the straps 43, 45 to the rear upper portion 12B. In FIG. 7, the straps 43, 45 have been secured to the rear upper portion 12B before the cord 16 is secured to the cord lock 18. The loop portion 16A is shown in the untensioned position in FIG. 7. The cord 16 locks to the cord lock 18 when the loop portion 16A is manually pulled outward in the direction of the force F and pivoted in the direction of arrow G to the locked position of FIG. 8 (shown in phantom in FIG. 7 as locked position L).

Figure 9:
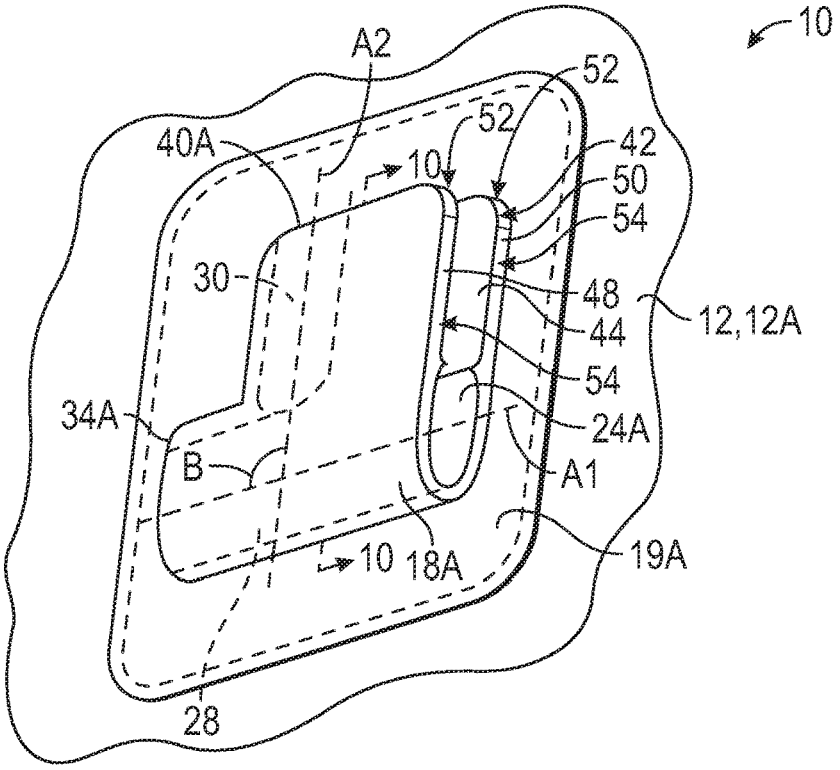
FIG. 9 is a fragmentary perspective view of a lateral body of the cord lock secured to a front upper portion of the article of footwear.
Figure 10:
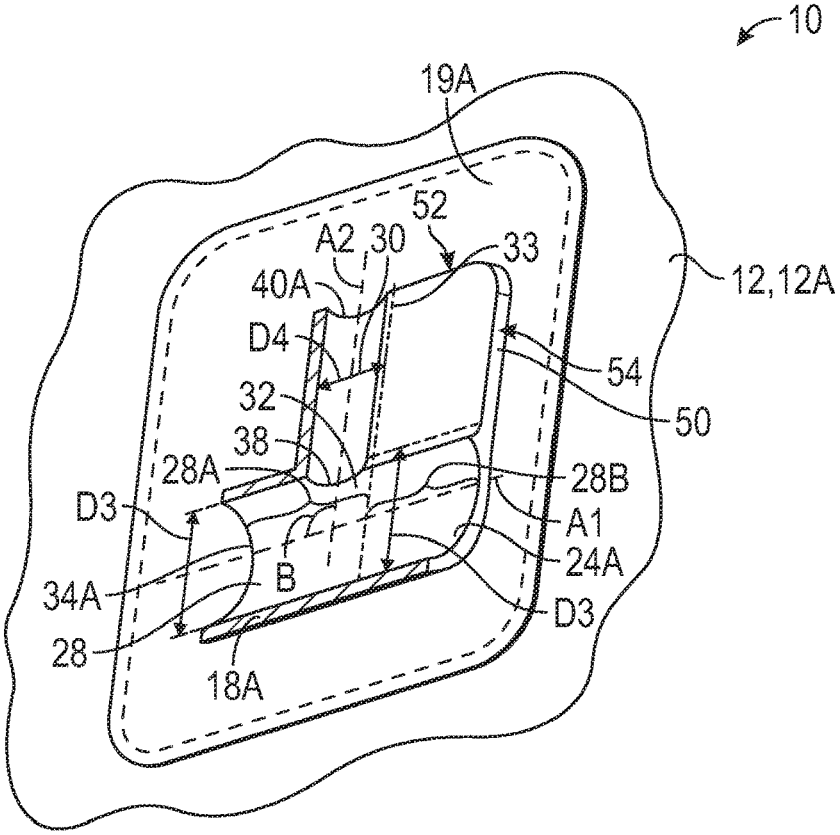
FIG. 10 is a cross-sectional fragmentary perspective view of the lateral body of the cord lock and the front upper portion taken at lines 10-10 in FIG. 9.

With reference to FIGS. 9 and 10, the first body 18A is shown and described in greater detail. The description of the first body 18A applies equally to the second body 18B as the second body 18B is configured symmetrically to the first body 18A. Each body 18A, 18B includes a first passage 28 and a second passage 30 that branches from an intermediate portion 32 of the first passage 28. Stated differently, the passages 28, 30 are in communication with one another at the intermediate portion 32. The body 18A defines an entrance opening 34A and a first exit opening 24A, and the first passage 28 extends from the entrance opening 34A to the first exit opening 24A. The second passage 30 extends from the first passage 28 to a second exit opening 40A defined by the body 18A. The first passage 28 includes a first segment 28A and a second segment 28B. The first segment 28A extends from the entrance opening 34A to the edge 33 (see FIG. 10) of the second passage 30 furthest from the entrance opening 34A. The second segment 28B extends from the edge 33 of the second passage 30 to the first exit opening 24A. In the embodiment shown, the first passage 28 is cylindrical and has a first diameter D3. A longitudinal axis A2 of the second passage 30 is disposed at an obtuse angle B with respect to the longitudinal axis A1 of the first passage 28, with the obtuse angle B being the angle between the longitudinal axis A1 at the entrance opening 34A and the longitudinal axis A2 at the second exit opening 40A. The second body 18B has corresponding first and second passages 28, 30 arranged in an identical manner relative to one another as in the first body 18A with an entrance opening 34B, a first exit opening 24B, and a second exit opening 40B (see FIG. 8).

The second passage 30 is in communication with the first passage 28 as an entrance 38 (see FIG. 10) of the second passage begins at the intermediate portion 32. In the embodiment shown, the second passage 30 is cylindrical and has a second diameter D4 that is less than the first diameter D3 of the first passage 28. Accordingly, the first cross-sectional area of the first passage 28 is greater than the second cross-sectional area of the second passage 30 as both are proportional to the square of their respective diameters D3, D4. The cross-sectional area of each passage 28 or 30 is taken perpendicular to its center axis A1 or A2. In other embodiments, only a portion of the second passage 30 has a smaller diameter than the first passage. For example, only a narrowed portion somewhere along the second passage 30 need be narrower than the untensioned diameter D1 of the cord 16 in order to lock the loop portion 16A of the cord 16 to the body 18A in the second passage 30.

The adjustment cord 16 is configured so that its diameter D2 when tensioned is less than the diameter D3 of the first passage 28. In the embodiment shown, the cord 16 is elastic, and is cylindrical in cross-section (e.g., at a section through the cord 16 taken perpendicular to its longitudinal axis). Accordingly, the cross-sectional area of the cord 16 when tensioned is less than the cross-sectional area of the first passage 28. This allows the cord 16 to move longitudinally relative to the first passage 28 (e.g., slide within the first passage 28) when the loop portion 16A is pulled away from the bodies 18A, 18B, such as in a direction along the longitudinal axis A1 of the first passage 28. The cross-sectional area of the cord 16 when tensioned may also be at least slightly less than the cross-sectional area of the second passage 30 and slightly less than the narrowed portion at width D5 (discussed in FIG. 11) to allow the tensioned cord 16 to pass into the second passage 30 when the loop portion 16A is repositioned from the first passage 28 to the second passage 30. The cross-sectional area of the cord 16 when not tensioned (e.g., its cross-sectional area when it has a diameter D1) is greater than a cross-sectional area of the second passage 30. This configuration allows the cord 16 to fit into the second passage 30 when pivoted to the second position, and then lock to the second passage 30 when the force F is removed, with the cord 16 filling the second passage 30 as it tries to return to its untensioned diameter D1. In embodiments in which the cord 16 is inelastic, its cross-sectional area may remain relatively unchanged when tensioned, but it may lock to the lock 18 in the second passage 30 by a friction fit and/or may slightly compress when manually placed in the second passage 30 (e.g., such as by pushing the cord 16 into the second passage 30 when pivoted). The lock bodies 18A, 18B thus act as pinch points on the cord 16, and the portion 16B between the anchor location 20 and the lock 18 remains tensioned. The portion of the cord 16 between the second exit opening 40A of the first body 18A and the second exit opening 40B of the second body 18B (e.g., the loop portion 16A) is untensioned (e.g., slack) and may have the diameter D1.

Referring to FIG. 9, an exterior surface 42 of the body 18A defines a slot 44 that extends from the first exit opening 24A to the second exit opening 40A. The slot 44 also extends inward from the exterior surface 42 into the body 18A along the segment 28B of the first passage 28 and along the second passage 30. The slot 44 does not extend along the segment 28A of the first passage 28 that is between the entrance opening 34A and the beginning of the second passage 30 (e.g., first segment 28A). The slot 44 enables the loop portion 16A of the adjustment cord 16 to be repositionable by pivoting the cord 16 in the body 18A through the slot 44 from the first position (FIG. 2) in which the adjustment cord 16 extends through the first exit opening 24A to the second position (FIG. 1) in which the adjustment cord 16 extends through the second exit opening 40A. The adjustment cord 16 extends through the entrance opening 34A in both the first position and the second position.

Adjustment of the cord 16 begins with a manual force applied to the loop portion 16A, pulling the loop portion 16A away from the front upper portion 12A. An example showing the direction of the force F is in FIG. 7. When the loop portion 16A is pivoted from the first position to the second position, the loop portion 16A exits the segment 28B and moves to the second passage 30 through the slot 44 in a pivoting motion (along arrow G in FIG. 7), pivoting generally at a pivot axis at the intersection of the center axes A1, A2. The pivoting motion can begin while the cord 16 is still stretching (if elastic) under the force F applied to the loop portion 16A, or after stretching of the loop portion 16A along the axis A1 is complete and the force F is held while the pivoting motion occurs. When the loop portion 16A moves into the second passage 30 and the force F on the loop portion 16A is removed, the locking of the loop portion 16A to the body 18A and to the body 18B at the respective second passages 30 holds (e.g., retains) the tension in the portion 16B.

Figure 11:
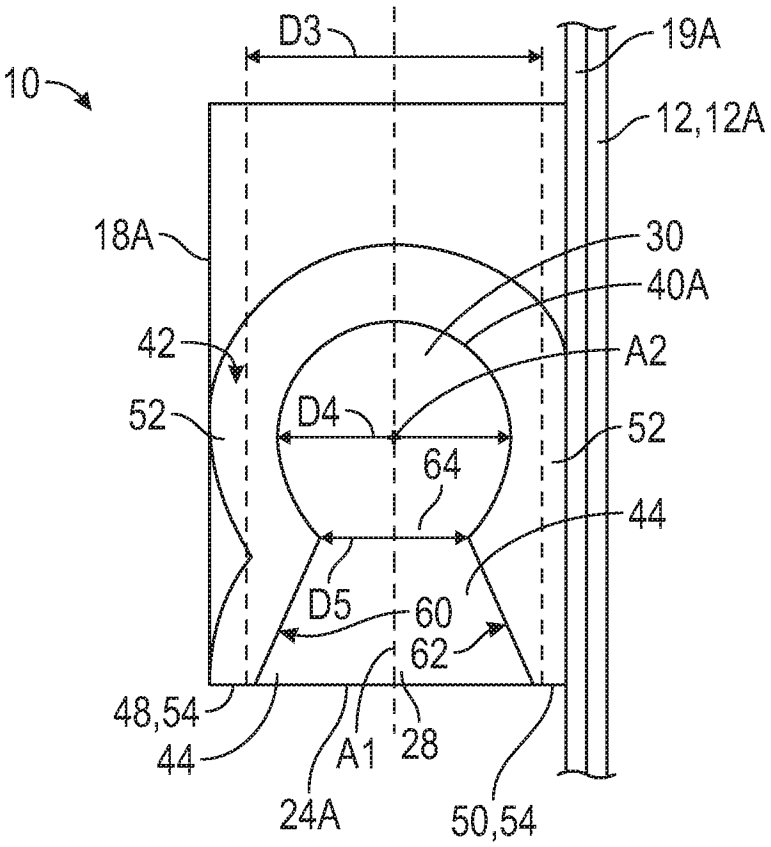
FIG. 11 is a fragmentary plan view of the lateral body of the cord lock and the front upper portion of FIG. 9.

Referring to FIG. 11 it is apparent from the plan view that the body 18A includes a first side wall 48 and a second side wall 50 spaced apart from the first side wall 48 by the slot 44. The first side wall 48 and the second side wall 50 extend along the segment 28B of the first passage 28. Stated differently, the first side wall 48 and the second side wall 50 extend beyond the intermediate portion 32 (where the second passage 30 branches from the first passage 28) all the way to the first exit opening 24A. The first side wall 48 and the second side wall 50 also extend along the second passage 30 to the second exit opening 40A. As best shown in FIG.

9, a top 52 of each of the side walls 48, 50 extends forward from the second exit opening 40A the length of the segment 28B. A front 54 of each of the side walls 48, 50 extends upward to meet the top 52. The second passage 30 and the segment 28B are thus completely within the body 18A. A forward portion of the first passage 28 (e.g., the second segment 28B closest to the front 54) and an upper portion of the second passage 30 (e.g., a portion closest to the top 52) open to the slot 44 along their lengths and may be accessed through the slot 44 to allow the cord 16 to exit the first segment 28A and be pivoted to the second passage 30 when tightening the cord 16. When releasing the cord 16 to loosen the front upper portion 12A, the slot 44 enables the cord 16 to exit the second passage 30 when the cord 16 is pivoted back to the segment 28B.

As best shown in FIG. 11, the first side wall 48 and the second side wall 50 are configured such that the slot 44 is narrower at an axial opening 64 of the second passage 30 bordering the slot 44 than at the front 54 of the body 18A. For example, the inner surface 60 of the first side wall 48 angles inward (e.g., into the slot 44) toward the second side wall 50 from the exterior surface 42 at the front 54 to the second passage 30 to narrow the slot 44. The inner surface 62 of the second side wall 50 angles inward toward the first side wall 48 in a similar manner. In other embodiments, only the first side wall 48 or only the second side wall 50 angles inward. In any embodiment, the axial opening 64 of the second passage 30 to the slot 44 has a width D5 that is less than the diameter D4 of the second passage 30. When the cord 16 is in the second passage 30 and a manually-applied tensioning force is removed, the cord 16, if elastic, begins expanding to its untensioned diameter D1 which is greater than the diameter D4. The cord 16 will thus be locked to the body 18A in the second passage 30, being constrained by the second passage 30 from fully expanding to the untensioned diameter D1. The narrowing of the slot 44 to the width D5 will further help to retain the cord 16 in the second passage 30 until it is again tensioned by an applied pulling force to thin the cord 16 to its tensioned diameter D2, which is less than the width D5, allowing the cord 16 to be pivoted back to the first passage 28 through the axial opening 64, and to thereby loosen the front upper portion 12A. In embodiments in which the cord 16 is inelastic, its cross-sectional area may remain relatively unchanged when tensioned, but it may lock to the lock 18 in the second passage 30 by a friction fit and/or may slightly compress when manually placed in the second passage 30 (e.g., such as by pushing the cord 16 into the second passage 30 when pivoted). In embodiments in which the cord 16 is "flat" (e.g., has a rectangular cross-section perpendicular to its length), the cord 16 may be folded along its length at the second passage 30 before or while being inserted into the second passage 30 by the pivoting motion. When the flat cord is elastic and is tensioned, the total cross-sectional of the flat cord is less than when it is untensioned. Additionally, folding a flat cord along its length will further enable it to lock in the lock body as its thickness will be doubled and it is biased to attempt to unfold and return to an unfolded state which will cause it to press against the lock body in the second passage 30. The second passages 30 of the bodies 18A, 18B thus act as pinch points on the cord 16, and the portion 16B between the anchor location 20 and the lock 18 remains tensioned. The portion of the cord 16 between the second exit opening 40A of the first body 18A and the second exit opening 40B of the second body 18B (e.g., the loop portion 16A) is untensioned (e.g., slack) and may have the diameter D1.

Figure 12:
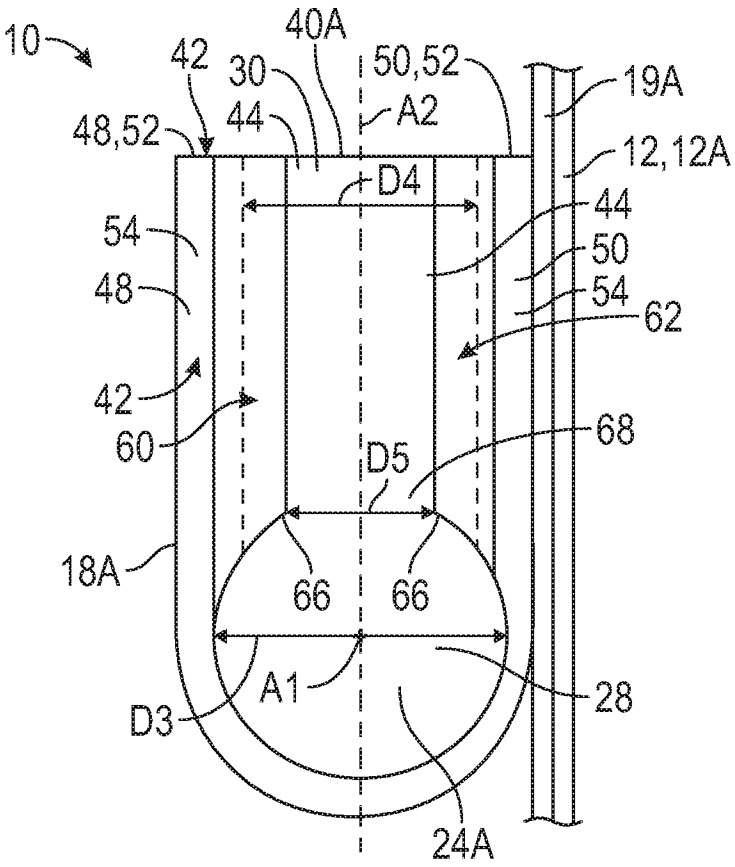
FIG. 12 is a fragmentary front view of the lateral body of the cord lock and the front upper portion of FIG. 9.

As best shown in FIG. 12, the inner surfaces 60, 62 of the side walls 48 and 50 protrude inward just above the first passage 28, as shown at the protrusions 66. The protrusions 66 ensure that the slot 44 also has only the width D5 at the axial opening 68 of the first passage 28 to the slot 44. In some embodiments, a series of protrusions configured as ribs may extend along the inner surfaces 60, 62 of the side walls 48 and 50 in a direction from the front 54 toward the axial opening 64. These protrusions may help prevent the cord 16 from moving from the second passage 30 to the first passage 28 without a manually-applied tensioning force narrowing the cord or otherwise enabling the cord 16 to be intentionally removed from the passage 30. Depending upon the material used for the body 18A, the first side wall 48 may be configured to flex away from the second side wall 50 when the adjustment cord 16 encounters the protrusions 66 with sufficient force during repositioning of the adjustment cord 16.

As shown in FIGS. 7 and 8, the first passage 28 of each of the first body 18A and the second body 18B extends forward and upward from the entrance opening 34A, 34B to the first exit opening 24A, 24B, respectively. The loop portion 16A extends generally forward from the first exit openings 24A, 24B when the adjustment cord 16 is in the first passage 28 and exits the first exit openings 24A, 24B. In FIG. 7, the cord 16 is in the untensioned state, with the loop portion 16A disposed in the first passages 28. The adjustment cord 16 thus makes a forward and upward turn from the cord guides 22C and 22D (disposed under the straps 43,45) to route through the respective first passages 28. In this arrangement, the first body 18A, the lateral cord guide 22C and the cord guide 22A at the anchor location 20 are arranged in a triangular spacing. Pulling the loop portion 16A in the direction of the force F (upward and forward) along the axes A1 of the first passages 28 (shown in FIG. 10), and while maintaining the force F, and subsequently or simultaneously pivoting the loop portion 16A (as represented by pivot arrow G in FIG. 7) rearward through the slot 44 of each of the bodies 18A, 18B to the second passage 30 moves the loop portion 16A to the locked position of FIG. 8, in which the tension in the portion 16B of the cord 16 is maintained.

As indicated in FIGS. 7 and 8 the second passage 30 of each of the first body 18A and the second body 18B extends rearward and upward from the intermediate portion 32 of each first passage 28 to the second exit opening 40A, 40B, respectively. The loop portion 16A extends generally upward and slightly rearward when the loop portion 16A extends in the second passages 30 and exits the second exit openings 40A, 40B. In the tensioned state, the front upper portion 12A is slightly closer to the front sole portion 15A over the midfoot region 23 and the forefoot region 25 (e.g., at the anchor location 20), and the lock 18 (e.g., bodies 18A, 18B) may be shifted slightly rearward relative to its positions in FIG. 7. To loosen the upper 12, the loop portion 16A is pulled upward and rearward along the axes A2 of the second passages 30, and simultaneously or subsequently pivoted through the slot 44 in the opposite direction of arrow G while maintaining the applied force to return to the untensioned, first position of FIG. 7, at which time the force F is released so that the adjustment cord 16, including the loop portion 16A and the portion 16B, returns to its untensioned state. Both tightening and loosening of the cord 16 and the resulting adjustment of the upper 12 can occur by pulling and pivoting the cord 16 as described with only one hand. The other hand is not needed to complete the adjustment and need not even be in contact with the footwear 10 during the adjustment.

Figure 13:
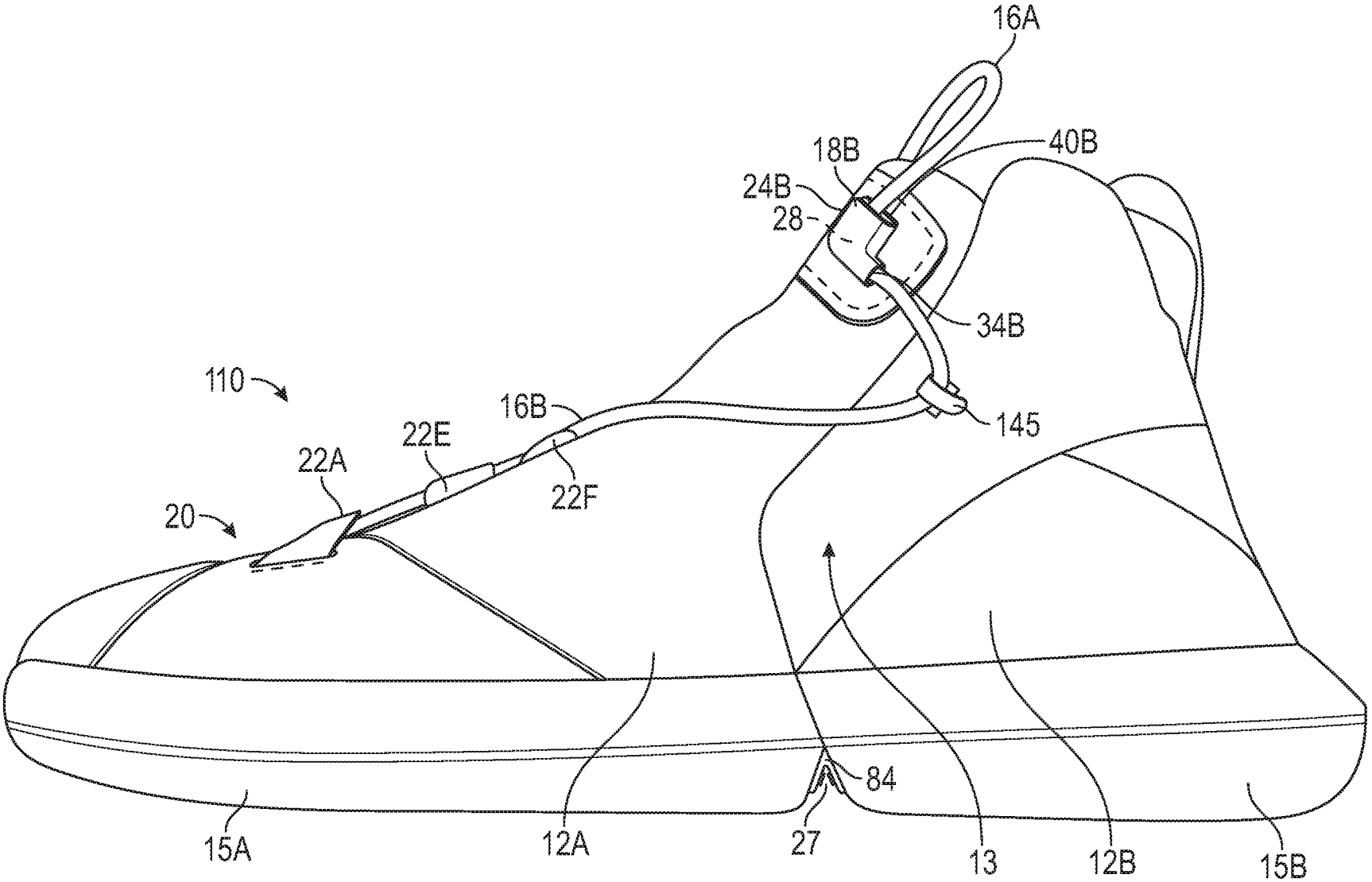
FIG. 13 is a medial side view of an article of footwear in a use position and with an adjustment cord locked to a cord lock.
Figure 14:
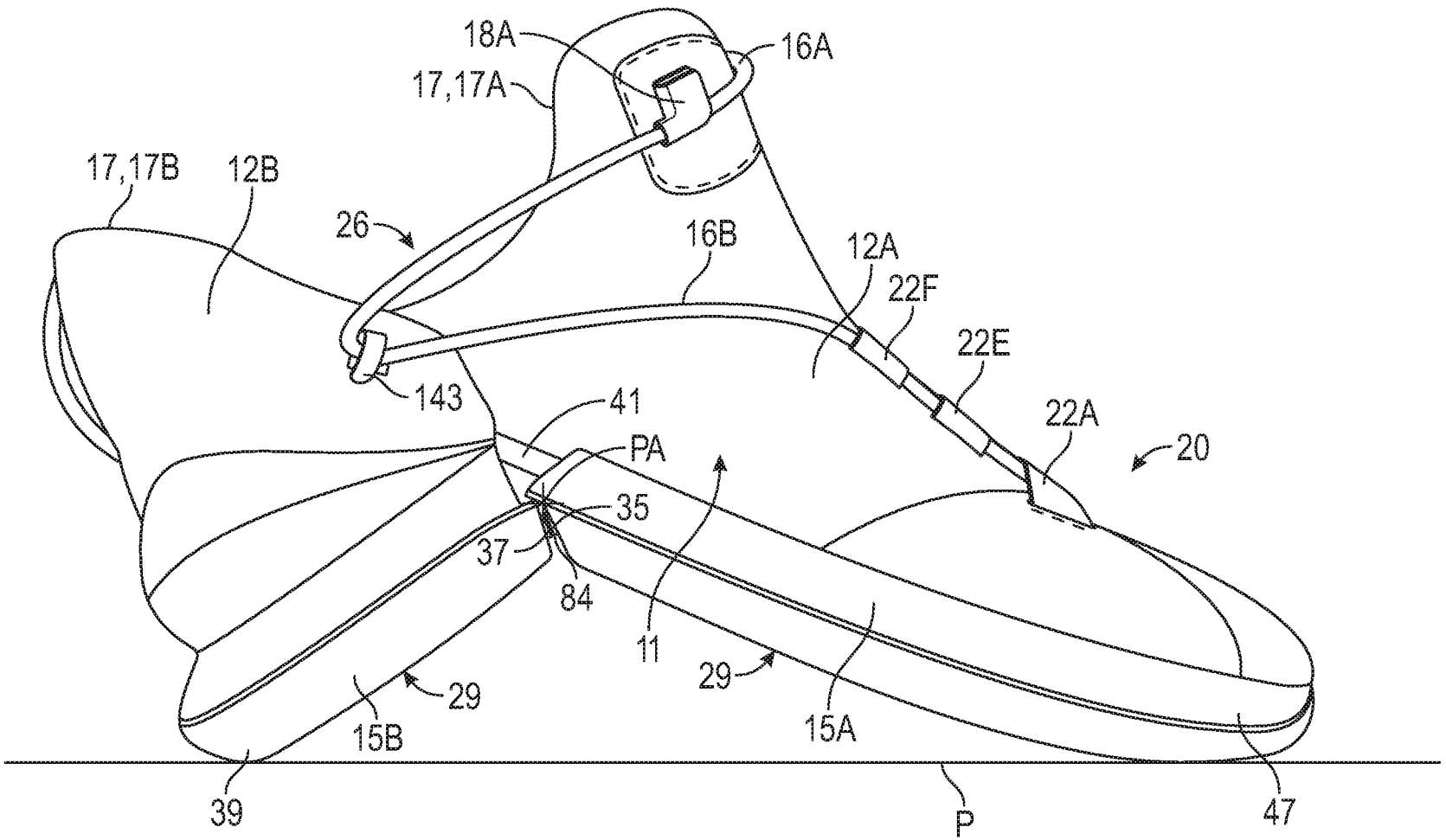
FIG. 14 is a lateral side view of the article of footwear of FIG. 13 in the access position with the adjustment cord unlocked.

FIGS. 13 and 14 show an alternative embodiment of an article of footwear 110 that is alike in all aspects to the article of footwear 10 except that a medial hook 145 and a lateral hook 143 are provided and the following components are not provided: the medial strap 45, the lateral strap 43, fastener components 37A, 37B, and 37C, and guides 22C and 22D. The medial hook 145 extends from the medial side 13 of the rear upper portion 12B. The lateral hook 143 extends from the lateral side 11 of the rear upper portion 12B. The cord 16 engages the medial hook 145 and the lateral hook 143 between the anchor location 20 and the lock bodies 18A, 18B of the cord lock 18. When the loop portion 16A is moved to lock the cord 16 to the lock bodies 18A, 18B, the engagement of the cord 16 with the hooks 143, 145 helps to retain the rear upper portion 12B and the front upper portion 12A in the use position. The cord 16 may extend through the hooks 143, 145 in the access position (as shown extending through the lateral hook 143 in FIG. 14), or the cord 16 may be disengaged from the hooks 143, 145 in the access position, and then positioned in the hooks 143, 145 once the footwear 110 is moved to the access position and prior to locking the cord 16 to the lock bodies 18A, 18B.

Figure 15:
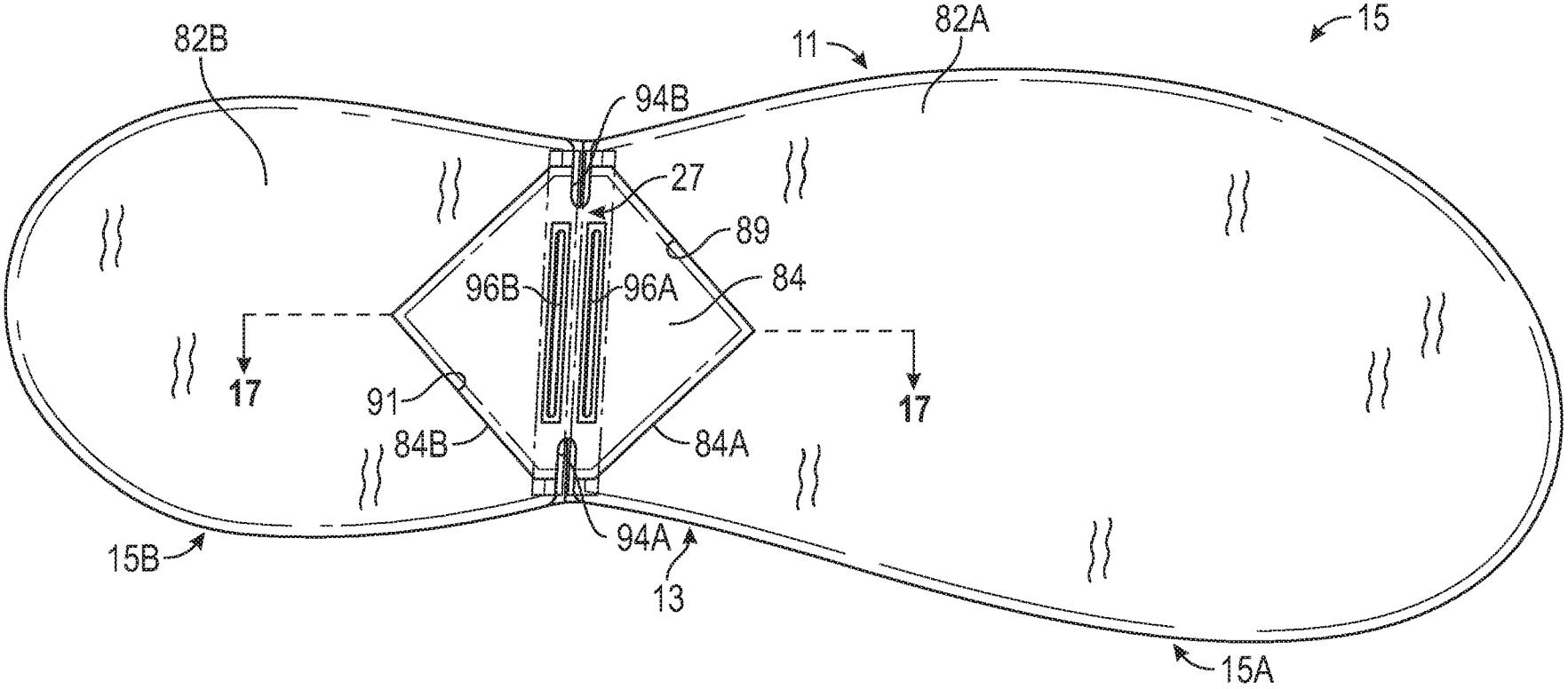
FIG. 15 is a bottom view of the sole structure of the article of footwear of FIG. 1.

FIG. 15 shows the connecting member 84 (e.g. the plate 84) included in both the article of footwear 10 and the article of footwear 110 in greater detail. The plate 84 may be a rigid or semi-rigid plastic such as a thermoplastic polyurethane and is pre-molded with the groove 27. In some embodiments, the plate 84 may be stiffer than the material of the front and rear outsole portions 82A, 82B to minimize torsion of the sole structure 15 at the plate 84. In other embodiments, the plate 84 may be the same material as the front and rear outsole portions 82A, 82B and may be considered to be part of the outsole. The plate 84 is connected to a rear wall 86 of the front midsole component 80A, and to the bottom of the front midsole component 80A forward of the rear wall 86. The plate 84 is also connected to the front wall 88 of the rear midsole component 80B, and to the bottom of the rear midsole component 80B just rearward of the rear wall 86. The plate 84 thus lines the front wall 88 and the rear wall 86 at the groove 27 and the groove 27 extends transversely between the medial side 13 and the lateral side 11 of the article of footwear 10.

The plate 84 has notches 94A, 94B at side edges of the plate 84 at the medial side 13 and the lateral side 11, respectively, near a peak 95 of the plate 84 over the groove 27 to reduce stress concentrations at the medial and lateral sides of the peak 95. The notches 94A, 94B may be smaller than shown, or the plate 84 may have no notches.

Ribs 96A, 96B may be secured at the respective walls 37, 35 of the plate 84 in the groove 27 and may extend outward into the groove 27. The ribs 96A, 96B may be the same material as the plate, or may be a harder or softer material, and may serve as reinforcing members and/or bumpers or spacers in the groove 27. For example, the ribs 96A, 96B may extend slightly outward from the walls 37, 35 into the groove 27 so that the ribs 96A, 96B rather than the walls 37, 35 contact one another in the access position (e.g., when the groove 27 is closed). The ribs 96A, 96B do not extend across the top of the groove 27 between the walls 37, 35 so as not to increase resistance to pivoting of the sole structure 15 at the groove 27.

Figure 17:
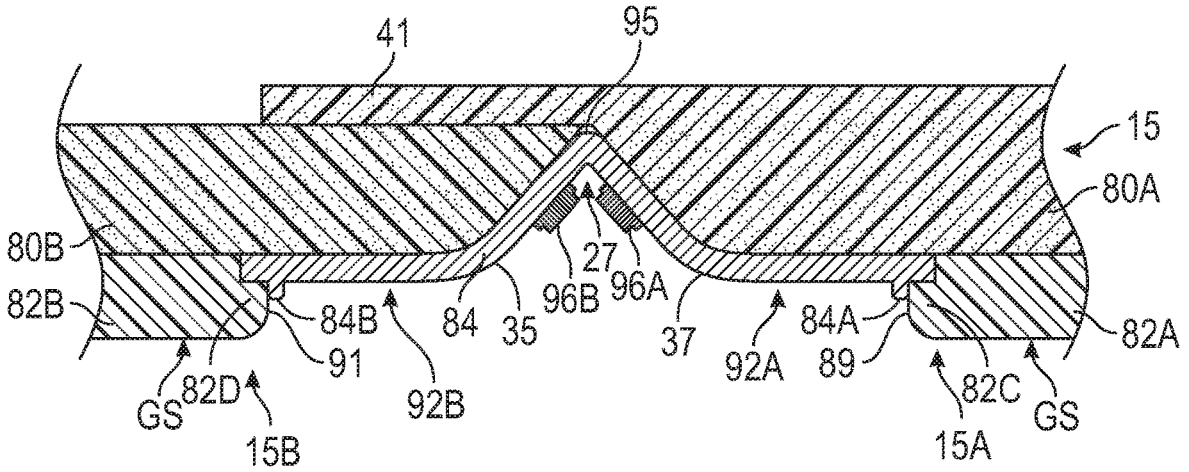
FIG. 17 is a cross-sectional view of the sole structure of FIG. 1 taken at lines 17-17 in FIG. 15.

The front outsole portion 82A underlies and is secured to the front midsole component 80A forward of the plate 84. The rear outsole portion 82B underlies and is secured to the rear midsole component 80B rearward of the plate 84. The front midsole component 80A and the rear midsole component 80B may be connected to the respective outsole portions 82A, 82B and to the plate 84 in this manner by bonding such as with adhesive, or by insert molding, co-molding, or additive 3-D printing. The plate 84 and the outsole portions 82A, 82B may be configured to interfit. For example, a rear edge 89 of the outsole portion 82A may be shaped to follow and/or abut a front rim 84A of the plate 84 from the medial side 13 to the lateral side 11 of the sole structure 15. Similarly, a forward edge 91 of the outsole portion 82B may be shaped to follow and/or abut a rear rim 84B of the plate 84 from the medial side 13 to the lateral side 11. As best shown in FIG. 17, the plate 84 may extend forward and rearward slightly beyond the rims 84A, 84B, respectively. The front outsole portion 82A may include a lip 82C that covers the front edge of the plate 84 forward of the front rim 84A. The rear outsole portion 82B may include a lip 82D that covers the rear edge of the plate 84 rearward of the rear rim 84B.

Figure 16:
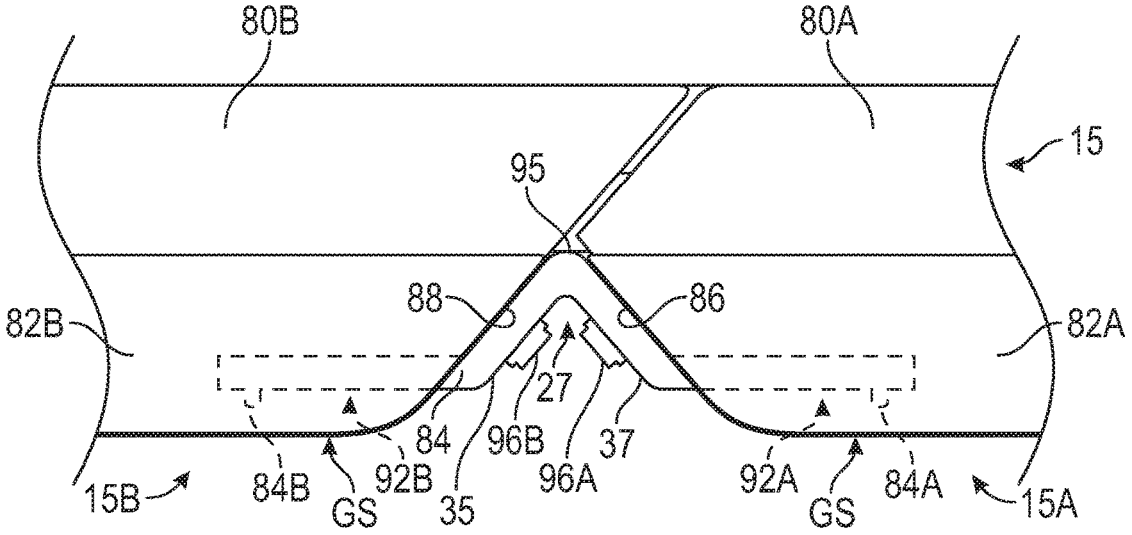
FIG. 16 is a fragmentary side view of the sole structure of FIG. 1.

As best shown in FIGS. 16 and 17, the outsole portions 82A, 82B are thicker than the plate 84 so that the plate 84 does not form part of the ground contact surface GS of the sole structure 15 (e.g., the surface of the sole structure 15 that would come into contact with the level ground plane P when the article of footwear 10 or 110 is in the use position). Instead, the thicker outsole portions 82A, 82B extending downward from the midsole components 80A, 80B create a first recess 92A at the bottom surface of the front sole portion 15A and a second recess 92B at the bottom surface of the rear sole portion 15B. The plate 84 is nested in the first recess 92A and in the second recess 92B so that it is raised from the ground contact surface GS of the outsole portions 82A, 82B.

The following Clauses provide example configurations of an article of footwear disclosed herein.

Clause 1: An article of footwear comprising: a sole structure having a front sole portion and a rear sole portion pivotable relative to the front sole portion between a use position and an access position; a footwear upper fixed to the front sole portion and to the rear sole portion; and a closure system comprising: an adjustment cord operatively secured to the footwear upper at an anchor location; and a cord lock secured to the footwear upper in a fixed position; wherein the cord lock is configured so that the adjustment cord slides through the cord lock when under tension to tighten the footwear upper in the use position, and is repositionable relative to the cord lock when tensioned to lock to the cord lock and retain tension in the adjustment cord.

Clause 2: The article of footwear of Clause 1, wherein the footwear upper includes a front upper portion fixed to the front sole portion and defining a forefoot region of the footwear upper, and a rear upper portion fixed to the rear sole portion and defining a heel region of the footwear upper; and the closure system further comprises a medial strap extending from a medial side of the front upper portion and a lateral strap extending from a lateral side of the front upper portion, the medial strap and the lateral strap securable to the rear upper portion to secure the front upper portion to the rear upper portion in the use position.

Clause 3: The article of footwear of Clause 2, wherein the medial strap and the lateral strap each include a fastener component, and the rear upper portion includes one or more complementary fastener components to which the fastener components of the medial strap and the fastener component of the lateral strap are selectively securable and releasable.

Clause 4: The article of footwear of any of Clauses 2-3, wherein the closure system further comprises: a medial cord guide secured to the medial side of the front upper portion and a lateral cord guide secured to the lateral side of the front upper portion, the adjustment cord engaging the medial cord guide and the lateral cord guide between the anchor location and the cord lock.

Clause 5: The article of footwear of Clause 4, wherein the medial cord guide is secured to the medial strap and the lateral cord guide is secured to the lateral strap.

Clause 6: The article of footwear of Clause 4, wherein the medial cord guide is secured to an inner side of the medial strap, and the lateral cord guide is secured to an inner side of the lateral strap.

Clause 7: The article of footwear of any of Clauses 2-6, wherein the closure system further comprises: at least one forefoot cord guide anchored to the front upper portion in the forefoot region; and wherein the adjustment cord engages the at least one forefoot cord guide at the anchor location to operatively secure the adjustment cord to the front upper portion.

Clause 8: The article of footwear of Clause 7, wherein the at least one forefoot cord guide includes a medial forefoot cord guide secured to the medial side of the front upper portion in the forefoot region, and a lateral forefoot cord guide secured to the lateral side of the front upper portion in the forefoot region.

Clause 9: The article of footwear of any of Clauses 7-8, wherein the closure system further comprises: at least one additional cord guide secured to the front upper portion; wherein the adjustment cord engages the at least one additional cord guide between the at least one forefoot cord guide and the cord lock.

Clause 10: The article of footwear of any of Clauses 2-9, wherein: in the use position, the front upper portion and the rear upper portion together define a foot-receiving cavity and an ankle opening; and in the access position, the front upper portion and the rear upper portion are spaced apart from one another so that the ankle opening is larger than in the use position.

Clause 11: The article of footwear of Clause 1, wherein the footwear upper includes a front upper portion fixed to the front sole portion and defining a forefoot region of the footwear upper, and a rear upper portion fixed to the rear sole portion, the rear upper portion defining a heel region of the footwear upper, and the closure system further comprises: a medial hook extending from a medial side of the rear upper portion and a lateral hook extending from a lateral side of the rear upper portion, the adjustment cord engaging the medial hook and the lateral hook between the anchor location and cord lock.

Clause 12: The article of footwear of Clause 1, wherein the footwear upper includes a front upper portion fixed to the front sole portion and defining a forefoot region of the footwear upper, and a rear upper portion fixed to the rear sole portion, the rear upper portion defining a heel region of the footwear upper; and the closure system further comprises a medial strap or a medial hook extending from a medial side of the rear upper portion, and a lateral strap or a lateral hook extending from a lateral side of the rear upper portion, the adjustment cord engaging the medial strap or the medial hook and the lateral strap or the lateral hook between the anchor location and cord lock.

Clause 13: The article of footwear of any of Clauses 1-12, wherein: the cord lock includes a first body secured to a lateral side of a tongue region of the footwear upper; the cord lock further includes a second body secured to a medial side of the tongue region of the footwear upper; the second body is configured symmetrically with the first body about a longitudinal midline of the article of footwear; and the adjustment cord includes a loop portion extending from an exit of the first body and from an exit of the second body.

Clause 14: The article of footwear of Clause 13, wherein the adjustment cord is tensioned by pulling the loop portion away from the first body and the second body.

Clause 15: The article of footwear of any of Clauses 13-14, wherein: each of the first body and the second body is configured with a first passage and a second passage branching from an intermediate portion of the first passage, the second passage narrower than the first passage; the adjustment cord is slidable through the first passage when under tension to tighten the footwear upper in the use position; and the adjustment cord is pivotable from a segment of the first passage to the second passage and locks to the cord lock in the second passage to retain tension in the adjustment cord.

Clause 16: The article of footwear of Clause 15, wherein the loop portion extends from an exit of the first body and from an exit of the second body; and the adjustment cord is moved to the second passage of each of the first body and the second body by pivoting the loop portion relative to the first body and the second body.

Clause 17: The article of footwear of Clause 16, wherein: each of the first body and the second body includes an inner side wall, an outer side wall spaced apart from the inner side wall, and at least one protrusion extending from the inner side wall or from the outer side wall; and the inner side wall is between the footwear upper and the outer side wall.

Clause 18: The article of footwear of any of Clauses 15-17, wherein each of the first body and the second body of the cord lock defines: an entrance opening, a first exit opening, a second exit opening, the first passage extending from the entrance opening to the first exit opening, the second passage extending from an intermediate portion of the first passage to the second exit opening; and each of the first body and the second body is configured with a segment of the first passage extending from the intermediate portion to the first exit opening in communication with the second passage.

Clause 19: The article of footwear of Clause 18, wherein: in each of the first body and the second body, the adjustment cord extends from the anchor location and through the first passage from the entrance opening to the first exit opening, and is repositionable from the segment of the first passage to the second passage to exit through the second exit opening; and at least a portion of the second passage is narrower than the first passage to lock the adjustment cord to the first body and to the second body when the adjustment cord is in the second passage of the first body and in the second passage of the second body.

Clause 20: The article of footwear of any of Clauses 18-19, wherein the loop portion of the adjustment cord extends generally forward from the first exit opening when the adjustment cord extends in the first passage and generally upward from the second exit opening when the loop portion extends in the second passage.

Clause 21: The article of footwear of any of Clauses 18-20, wherein an angle between a longitudinal axis of the first passage and a longitudinal axis of the second passage and between the entrance opening and the second exit opening is an obtuse angle.

Clause 22: The article of footwear of any of Clauses 1-21, wherein the sole structure pivots at a transverse axis of the sole structure between the use position and the access position, and is elevated at the transverse axis further away from a ground plane in the access position than in the use position, the rear sole portion inclining from a rear end of the rear sole portion to the transverse axis, and the front sole portion inclining from a forward end of the front sole portion to the transverse axis in the access position.

Clause 23: The article of footwear of any of Clauses 1-22, wherein: the front sole portion includes a front midsole component and the rear sole portion includes a rear midsole component discontinuous from the front midsole component; the sole structure includes a connecting member connecting the front midsole component to the rear midsole component and defining a groove extending transversely between the front midsole component and the rear midsole component; the front midsole component and the rear midsole component are pivotable relative to one another at the groove between a use position and an access position; and confronting surfaces of the connecting member at the groove are closer to one another in the access position than in the use position so that the groove is relatively open in the use position, and the groove is relatively closed in the access position.

Clause 24: The article of footwear of Clause 23, wherein the connecting member comprises a plate defining the groove and secured to a rear wall of the front midsole component and to a front wall of the rear midsole component at the groove.

Clause 25: The article of footwear of Clause 24, further comprising: a rib secured at a wall of the connecting member in the groove and extending outward into the groove Clause 26: The article of footwear of Clause 24, wherein: the sole structure includes an outsole with a front portion underlying and secured to the front midsole component forward of the plate, and a rear portion underlying and secured to the rear midsole component rearward of the plate.

Clause 27: The article of footwear of Clause 26, wherein: the front sole portion has a bottom surface with a first recess; the rear sole portion has a bottom surface with a second recess; and the plate is nested in the first recess and the second recess.

Clause 30: An article of footwear comprising: a sole structure having a front sole portion and a rear sole portion pivotable relative to the front sole portion between a use position and an access position; a divided footwear upper including a front upper portion fixed to the front sole portion and defining a forefoot region of the divided footwear upper, and a rear upper portion fixed to the rear sole portion and defining a heel region of the divided footwear upper; a closure system comprising: an adjustment cord operatively secured to the front upper portion at an anchor location; and a cord lock secured to the front upper portion; a medial strap extending from a medial side of the front upper portion and a lateral strap extending from a lateral side of the front upper portion, the medial strap and the lateral strap securable to the rear upper portion to secure the front upper portion to the rear upper portion in the use position; and a medial cord guide secured to an inner side of the medial strap and a lateral cord guide secured to an inner side of the lateral strap, the adjustment cord engaging the medial cord guide and the lateral cord guide between the anchor location and the cord lock; wherein the cord lock is configured so that the adjustment cord slides through the cord lock when under tension to tighten the front upper portion, and is repositionable relative to the cord lock when tensioned to lock to the cord lock and retain tension in the adjustment cord, tensioning of the adjustment cord pulling the rear upper portion toward the front upper portion when the medial strap and the lateral strap are secured to the rear upper portion via engagement with the medial cord guide and the lateral cord guide at the inner side of the medial strap and the lateral strap.

Clause 31: The article of footwear of Clause 30, wherein the front sole portion includes a heel footbed that extends rearward over the rear sole portion in the use position.

Clause 32: The article of footwear of any of Clauses 30-31, wherein: the cord lock includes a first body secured to a lateral side of a tongue region of the front upper portion; the cord lock further includes a second body secured to a medial side of the tongue region of the front upper portion; the second body is configured symmetrically with the first body about a longitudinal midline of the article of footwear; and the adjustment cord includes a loop portion extending from an exit of the first body and from an exit of the second body.

Clause 33: The article of footwear of Clause 32, wherein each of the first body and the second body of the cord lock defines: an entrance opening, a first exit opening, a second exit opening, a first passage extending from the entrance opening to the first exit opening, a second passage extending from an intermediate portion of the first passage to the second exit opening; and each of the first body and the second body is configured with a segment of the first passage extending from the intermediate portion to the first exit opening in communication with the second passage.

Clause 34: The article of footwear of any of Clauses 30-33, wherein the adjustment cord is elastic.

Clause 35: The article of footwear of any of Clauses 30-33, wherein the adjustment cord is inelastic.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure having a front sole portion and a rear sole portion pivotable relative to the front sole portion between a use position and an access position;

a footwear upper fixed to the front sole portion and to the rear sole portion; and a closure system comprising:

an adjustment cord operatively secured to the footwear upper at an anchor location; and a cord lock secured to the footwear upper in a fixed position; wherein the cord lock has a body that includes:

a first passage and a second passage branching from an intermediate portion of the first passage, the second passage narrower than the first passage;

an entrance opening, a first exit opening, and a second exit opening;

the first passage including a first segment extending from the entrance opening to an edge of the second passage at the intermediate portion, the first passage including a second segment extending from the edge of the second passage to the first exit opening and in communication with the second passage, and the second passage extending from the intermediate portion of the first passage to the second exit opening and spaced apart from the first exit opening by the second segment of the first passage;

the adjustment cord is slidable through the first passage when under tension to tighten the footwear upper in the use position; and the adjustment cord is pivotable from the first segment of the first passage to the second passage and locks to the cord lock in the second passage to tighten the footwear upper when the sole structure is in the use position to retain tension in the adjustment cord.

2. The article of footwear of claim 1, wherein the footwear upper includes a front upper portion fixed to the front sole portion and defining a forefoot region of the footwear upper, and a rear upper portion fixed to the rear sole portion and defining a heel region of the footwear upper; and the closure system further comprises at least one of a medial strap extending from a medial side of the front upper portion and a lateral strap extending from a lateral side of the front upper portion, the at least one of the medial strap and the lateral strap securable to the rear upper portion to secure the front upper portion to the rear upper portion in the use position.

3. The article of footwear of claim 2, wherein the at least one of the medial strap and the lateral strap includes both of the medial strap and the lateral strap, the medial strap and the lateral strap each include a fastener component, and the rear upper portion includes one or more complementary fastener components to which the fastener component of the medial strap and the fastener component of the lateral strap are selectively securable and releasable.

4. The article of footwear of claim 2, wherein the closure system further comprises:

at least one of a medial cord guide secured to the medial side of the front upper portion and a lateral cord guide secured to the lateral side of the front upper portion, the adjustment cord engaging the at least one of the medial cord guide and the lateral cord guide between the anchor location and the cord lock.

5. The article of footwear of claim 4, wherein the at least one of the medial strap and the lateral strap includes both of the medial strap and the lateral strap, the medial cord guide is secured to the medial strap, and the lateral cord guide is secured to the lateral strap.

6. The article of footwear of claim 5, wherein the medial cord guide is secured to an inner side of the medial strap, and the lateral cord guide is secured to an inner side of the lateral strap.

7. The article of footwear of claim 2, wherein the closure system further comprises at least one forefoot cord guide anchored to the front upper portion in the forefoot region; and wherein the adjustment cord engages the at least one forefoot cord guide to operatively secure the adjustment cord to the front upper portion.

8. The article of footwear of claim 7, wherein the at least one forefoot cord guide includes a medial forefoot cord guide secured to the medial side of the front upper portion in the forefoot region, and a lateral forefoot cord guide secured to the lateral side of the front upper portion in the forefoot region.

9. The article of footwear of claim 7, wherein:

the closure system further comprises at least one additional cord guide secured to the front upper portion; and the adjustment cord engages the at least one additional cord guide between the at least one forefoot cord guide and the cord lock.

10. The article of footwear of claim 1, wherein the footwear upper includes a front upper portion fixed to the front sole portion and defining a forefoot region of the footwear upper, and a rear upper portion fixed to the rear sole portion, the rear upper portion defining a heel region of the footwear upper; and the closure system further comprises a medial hook extending from a medial side of the rear upper portion and a lateral hook extending from a lateral side of the rear upper portion, the adjustment cord engaging the medial hook and the lateral hook between the anchor location and the cord lock.

11. The article of footwear of claim 1, wherein:

the body is a first body secured to a lateral side of a tongue region of the footwear upper;

the cord lock further includes a second body secured to a medial side of the tongue region of the footwear upper; and the adjustment cord is a continuous cord forming a loop portion extending from the second exit opening of the first body and from an exit opening of the second body when the adjustment cord is pivoted from the first segment of the first passage to the second passage.

12. The article of footwear of claim 11, wherein:

each of the first body and the second body includes an inner side wall, an outer side wall spaced apart from the inner side wall, and at least one protrusion extending from the inner side wall or from the outer side wall; and the inner side wall is between the footwear upper and the outer side wall.

13. The article of footwear of claim 11, wherein the second body of the cord lock defines:

an additional entrance opening, an additional first exit opening, an additional second exit opening, an additional first passage extending from the additional entrance opening to the additional first exit opening, an additional second passage extending from an intermediate portion of the additional first passage to the additional second exit opening, the additional first passage including a first segment extending from the additional entrance opening to an edge of the additional second passage at the intermediate portion, and the additional first passage including a second segment extending from the edge of the second passage to the additional first exit opening and in communication with the second passage; and the exit opening of the second body from which the loop portion extends is the second exit opening.

14. The article of footwear of claim 13, wherein:

in the first body, the adjustment cord extends from the anchor location and through the first passage from the entrance opening to the first exit opening, and is repositionable from the second segment of the first passage to the second passage to exit through the second exit opening;

in the second body, the adjustment cord extends from the anchor location and through the additional first passage from the additional entrance opening to the additional first exit opening, and is repositionable from the first segment of the additional first passage to the additional second passage to exit through the additional second exit opening; and at least a portion of the second passage is narrower than the first passage to lock the adjustment cord to the first body and at least a portion of the additional second passage is narrower than the additional first passage to lock the adjustment cord to the second body when the adjustment cord is in the second passage of the first body and in the additional second passage of the second body.

15. The article of footwear of claim 13, wherein the loop portion of the adjustment cord extends generally forward from the first exit opening of the first body and the additional first exit opening of the second body when the adjustment cord extends in the first passage and generally upward from the second exit opening of the first body and the additional second exit opening of the second body when the loop portion extends in the second passage.

16. The article of footwear of claim 13, wherein an angle between a longitudinal axis of the first passage and a longitudinal axis of the second passage and between the entrance opening and the second exit opening is an obtuse angle.

17. The article of footwear of claim 1, wherein the sole structure pivots at a transverse axis of the sole structure between the use position and the access position, and is elevated at the transverse axis further away from a ground plane in the access position than in the use position, the rear sole portion inclining from a rear end of the rear sole portion to the transverse axis, and the front sole portion inclining from a forward end of the front sole portion to the transverse axis in the access position.

18. The article of footwear of claim 1, wherein:

the front sole portion includes a front midsole component and the rear sole portion includes a rear midsole component discontinuous from the front midsole component;

the sole structure includes a connecting member connecting the front midsole component to the rear midsole component and defining a groove extending transversely between the front midsole component and the rear midsole component;

the front midsole component and the rear midsole component are pivotable relative to one another at the groove between the use position and the access position; and confronting surfaces of the connecting member at the groove are closer to one another in the access position than in the use position so that the groove is relatively open in the use position, and the groove is relatively closed in the access position.

19. The article of footwear of claim 18, wherein the connecting member comprises a plate defining the groove and secured to a rear wall of the front midsole component and to a front wall of the rear midsole component at the groove.

20. The article of footwear of claim 14, wherein the second passage is entirely inward of the inner side wall and the outer side wall and spaced apart from the first exit opening by a length of the second section of the first passage.

* * * * *